US007883074B2

(12) United States Patent
Pavlov

(10) Patent No.: US 7,883,074 B2
(45) Date of Patent: Feb. 8, 2011

(54) SYSTEM AND METHODS FOR FORMING BARBED TAPE PRODUCT WITH PREDETERMINED PATTERNS OF ATTACHMENT POINTS INCLUDING PATTERNS FOR CONCERTINA TAPE PRODUCTS CONFIGURED FOR STABLE DEPLOYMENT AND RETIEVAL

(76) Inventor: Michael V. Pavlov, Route 32, P.O. Box 209, Bloomington, NY (US) 12411

( * ) Notice: Subject to any disclaimer, the term of this patent is extended or adjusted under 35 U.S.C. 154(b) by 328 days.

(21) Appl. No.: 10/585,166

(22) PCT Filed: Jul. 19, 2005

(86) PCT No.: PCT/US2005/025658

§ 371 (c)(1),
(2), (4) Date: May 6, 2009

(87) PCT Pub. No.: WO2006/014684

PCT Pub. Date: Feb. 9, 2006

(65) Prior Publication Data

US 2009/0233021 A1 Sep. 17, 2009

Related U.S. Application Data

(60) Provisional application No. 60/589,668, filed on Jul. 19, 2004.

(51) Int. Cl.
*E04H 17/02* (2006.01)

(52) U.S. Cl. ..... 256/2

(58) Field of Classification Search ..... 256/2–9
See application file for complete search history.

(56) References Cited

U.S. PATENT DOCUMENTS

| | | | | | |
|---|---|---|---|---|---|
| 2,910,256 | A | * | 10/1959 | Leidolf | 245/1 |
| 3,070,946 | A | * | 1/1963 | Kirsch et al. | 57/1 R |
| 3,155,374 | A | * | 11/1964 | Sieffert | 256/2 |
| 3,199,807 | A | * | 8/1965 | Kirsch et al. | 242/129 |
| 4,484,729 | A | * | 11/1984 | Mainiero et al. | 256/1 |
| 4,503,423 | A | * | 3/1985 | Mainiero et al. | 340/552 |
| 4,906,975 | A | * | 3/1990 | Casella et al. | 340/566 |
| 4,915,359 | A | * | 4/1990 | Cochrane | 256/10 |
| 4,978,943 | A | * | 12/1990 | Mainiero et al. | 340/566 |
| 5,074,529 | A | * | 12/1991 | Mainiero et al. | 256/8 |
| 5,139,234 | A | * | 8/1992 | Cochrane | 256/8 |
| 6,077,005 | A | * | 6/2000 | Westlake | 410/49 |

(Continued)

*Primary Examiner*—Joshua T Kennedy
(74) *Attorney, Agent, or Firm*—Schmeiser, Olsen & Watts LLP

(57) ABSTRACT

In barbed tape products, adjacent pairs of loops may be attached to each other at an attachment point that is circumferentially offset relative to an attachment point of the adjacent pair of loops. A system for producing a barbed taped product is controlled by an electronic controller to provide a predetermined pattern of attachment points. A pattern of attachment may be varied from roll to roll, between rolls, and/or within a given roll to provide a predetermined natural configuration of the product in a deployed state. The system and method eliminates the need for ceasing production between rolls in order to re-thread. Attachment elements are sized and configured for strength and accuracy in automatically attached barbed tape products. A deployment system and associated products utilize a magazine for holding and dispensing the products. The products may have any of a number of internal and external gasses for rigidifying the product.

5 Claims, 21 Drawing Sheets

U.S. PATENT DOCUMENTS

D429,342 S * 8/2000 Binns ..... D25/46
7,290,756 B2 * 11/2007 Pavlov ..... 256/2
7,325,787 B1 * 2/2008 Gibbs ..... 256/11
7,331,568 B2 * 2/2008 Cochrane ..... 256/2
7,419,140 B2 * 9/2008 Perry ..... 256/2
2003/0099523 A1 * 5/2003 Pessach et al. ..... 410/42
2006/0214148 A1 * 9/2006 Major et al. ..... 256/8

* cited by examiner

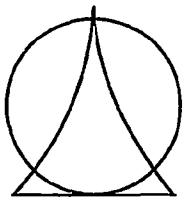
FIG. 16A
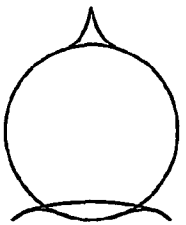
FIG. 16B
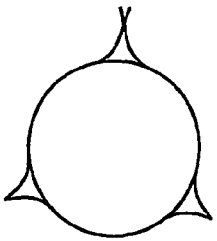
FIG. 16C
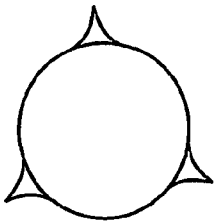
FIG. 16D
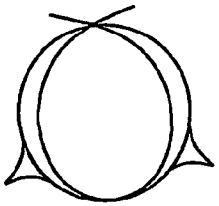
FIG. 16E
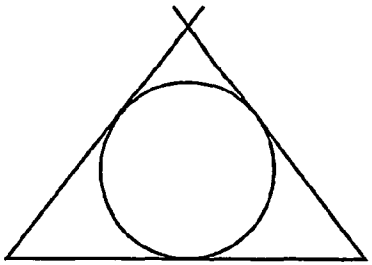
FIG. 16F
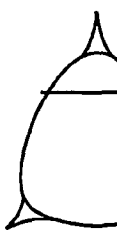
FIG. 16G
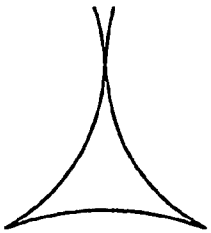
FIG. 16H
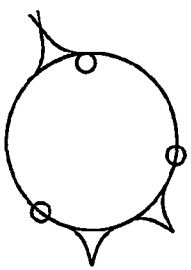
FIG. 16I
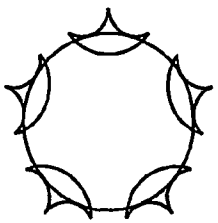
FIG. 16J
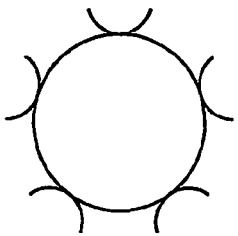
FIG. 16K
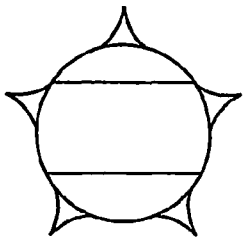
FIG. 16L
FIG. 16M
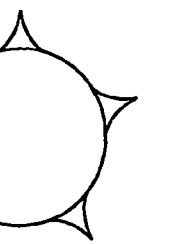
FIG. 16N
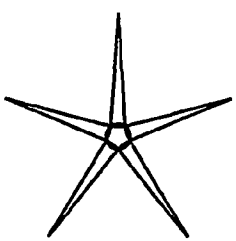
FIG. 16O
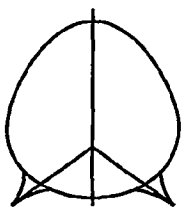
FIG. 16P

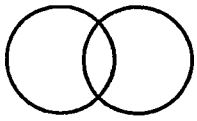
FIG. 17A
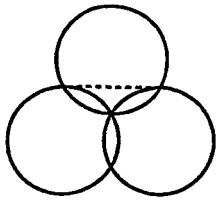
FIG. 17B
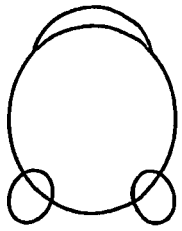
FIG. 17C
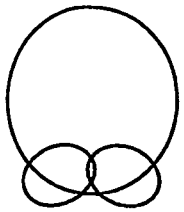
FIG. 17D
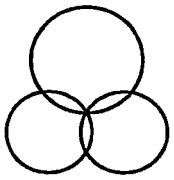
FIG. 17E
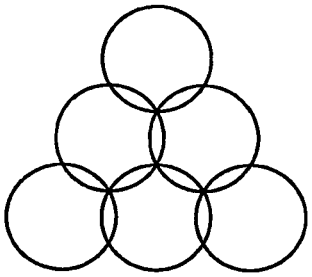
FIG. 17F
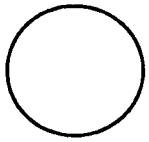
FIG. 17G
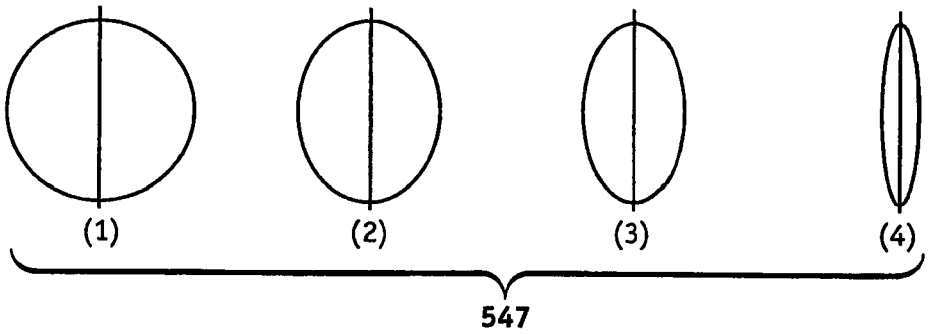
FIG. 18A
550
| | WIDTH (IN) | LENGTH (FT) |
|---|---|---|
| 1 | 74 | 0 |
| 2 | 60 | 650 |
| 3 | 20 | 900 |
| 4 | 0 | 1000 |
FIG. 18B

SYSTEM AND METHODS FOR FORMING BARBED TAPE PRODUCT WITH PREDETERMINED PATTERNS OF ATTACHMENT POINTS INCLUDING PATTERNS FOR CONCERTINA TAPE PRODUCTS CONFIGURED FOR STABLE DEPLOYMENT AND RETIEVAL

This application claims the benefit of U.S. Provisional Patent Application Ser. No. 60/589,668, entitled RAPID DEPLOYMENT BARBED TAPE AND DISPENSER, by the same inventor, filed Jul. 19, 2004, the disclosure of which is incorporated herein by reference.

BACKGROUND OF THE INVENTION

1. Technical Field

This invention generally relates to a barbed tape product, and more particularly to a barbed tape product having a predetermined pattern of attachment points. This invention generally relates to machines for forming barbed tape products, and more particularly to a system and method for automatically forming barbed tape concertina product. This invention generally relates to concertina tape products and systems for stable deployment and retrieval of the products. The present invention specifically relates to a tape product having a concertina coil and at least one of an internal truss and external truss connected to the coil at a plurality of connection points.

2. State of the Art

Barbed tape products are known. Much of the process of making such products has been automated. For example, forming the barbs from a stock tape material has been automated. Also, placement of a reinforcing wire within a channel formed in the tape has been automated. Bending of the barbed tape product into round coils is also part of known production processes. However, automatically and efficiently clipping adjacent strands of barbed tape product together has been virtually unsuccessful. Accordingly, most manufacturers rely upon manually attaching adjacent strands of the product in a concertina or other pattern. Most concertina products have three attachment elements for every two winds (or loops) of the product strand. These elements are generally placed at equally spaced circumferential positions along the product strand. Known barbed tape concertina products seldom purposely depart from this pattern except for between rolls when attaching is suspended, the strand is severed, and the machine is re-threaded for a subsequent roll of product.

Attachment elements such as generally U-shaped clips with arms that extend from a base and surround a pair of strands are known. In these clips, the arms interleave with each other in an attached configuration. These clips are attached with a clip gun that is typically actuated by a human operator. For convenience, multiple clips are held together in a string by a pair of filaments. The string of clips is fed into the clip gun so that the clip gun may be actuated repeatedly.

DISCLOSURE OF THE INVENTION

The present invention relates to a barbed tape product having a predetermined pattern of attachment points and attachment elements. The predetermined pattern of attachment points is programmed into an electronic controller of a system for automatically producing a concertina or other barbed tape product. This system may include the automation applied on past devices. However, the system also advantageously provides automated positioning of attachment points and automated attachment by attachment elements. The system provides a high degree of accuracy wherein the attachment points and the attachment elements may be placed in the predetermined pattern with few if any misplaced attachments. This system and associated methods are the subject of a U.S. patent application Ser. No. 10/959,944, by the same Applicant as this Application, entitled "SYSTEM AND METHODS FOR FORMING BARBED TAPE PRODUCT", filed Oct. 5, 2004, the disclosure of which is incorporated herein by reference.

A barbed tape product may have adjacent pairs of loops in which the loops of a pair are attached to each other at an attachment point that is circumferentially offset relative to an attachment point of the adjacent pair of loops. Additional attachment points may be provided in helically progressive positions between the first and second attachment points. The attachment points are positioned on one pair of loops so that each of the attachment points are circumferentially offset relative to all other attachment points on an adjacent pair of loops. The attachment points may be positioned in a predetermined helically progressive pattern on a coil of the product. The pattern may provide a predetermined natural configuration of the product when the product is in a deployed state of use. Attachment elements for attaching strands of the product together may be sized and configured for strength and accuracy in automatically attached concertina or other barbed tape products.

A system and method for producing a barbed taped product may be controlled by an electronic controller to provide a predetermined pattern of attachment points. The system may automatically clip adjacent loops of product strands together in the predetermined pattern. The system is capable of varying the pattern from roll to roll, within a given roll, and between rolls. The system and method eliminates the need for ceasing production between rolls in order to re-thread.

A deployment system and associated products utilize a magazine for holding and dispensing the products. The products may have any of a number of internal and external trusses that may be in tension and/or compression for rigidifying the product in selected directions. Thus the product may be shaped to fit a predetermined contour. The magazine may be supported on a deployment vehicle for ease of deployment of the product.

While barbed tape products of the past have generally been limited to the standard repeating patterns described above, the present invention is not limited in the same way. Rather, any pattern may be programmed into the electronic controller and the product may be made accordingly. One aspect of the invention that is believed to be advantageous in reducing misplaced attachments involves circumferentially offsetting attachment points on one cycle of the product relative to an adjacent cycle. For concertina products, this translates into offsetting the attachment points of one pair of loops of the product relative to the attachment points on an adjacent pair of loops. This, together with other aspects of the invention, has enabled automatic clipping by a clipping gun integrated into the system with few if any misclips. Another aspect that facilitates automation of the clipping process involves providing modified attachment elements or clips. Certain standard clips are available on the market. These clips are configured to be used with pairs of strands of a particular size. However, these clips require a great deal of accuracy in placement of the clipping gun relative to the strands in order to avoid misclipping. Hence, clips that cover larger areas than the standard clips available on the market have been developed. These clips are manufactured with certain strengthening processes that have been implemented in the production of the clips of the present invention. Hence, providing the strengthening and increasing the area covered by the clips provide advantages that were not previously enjoyed in the industry. The resulting products will be described in simple terms in the paragraphs that follow.

In one aspect, the invention may include a strand of the product in the form of a continuous helical coil. The strand of product may include at least a first pair of loops and a second pair of loops. A first attachment element may hold the first pair of loops together. A second attachment element may hold the second pair of loops together. The first attachment element may be circumferentially offset relative to the second attachment element.

The first and second pairs of loops may be adjacent pairs of loops. At least one additional attachment element may be provided on the strand in a helically progressive position between the first attachment element and the second attachment element. The at least one additional attachment element may hold the first and second pairs of loops together. In particular, a plurality of additional attachment elements may be provided on the strand in helically progressive positions between the first and second attachment elements.

The strand of the product may further include additional pairs of loops and additional attachment elements holding the loops of each pair together and holding the pairs of loops together. The attachment elements may be generally positioned on one pair of loops so that each attachment element is circumferentially offset relative to all other attachment elements on an adjacent pair of loops.

In another aspect, a barbed tape product may include a strand of the product in the form of a continuous helical coil with a first attachment configuration including at least a first attachment point on the strand. A second attachment configuration may including at least a second attachment point on the strand. The first and second configurations may correspond to respective first and second lengths of the strand that each extend through an arc of approximately 360 degrees or more. The first attachment point may be circumferentially offset relative to all second attachment points in the second length, including the second attachment point.

The barbed tape product may have a first fastener or attachment at the first attachment point and a second fastener or attachment at the second attachment point. The first and second fasteners or attachments attach the first length to the second length of the strand and the first and second lengths form adjacent first and second loops of the strand corresponding to respective first and second adjacent cycles.

The first attachment configuration may include a plurality of first attachment points including the first attachment point. The second attachment configuration may include a plurality of second attachment points including the second attachment point. Each of the plurality of first attachment points may be circumferentially offset relative to each of the plurality of second attachment points. The barbed tape product may include a plurality of first fasteners or attachments at the plurality of first attachment points and a plurality of second fasteners or attachments at the plurality of second attachment points. For a concertina product, the plurality of first attachments and the plurality of second attachments attach first and second pairs of loops comprising adjacent lengths of the strand together. The first and second pairs of loops correspond to respective first and second adjacent cycles and have a helically progressive pattern of attachment points forming a barbed tape concertina product. For a non-concertina product, the plurality of first attachments and the plurality of second attachments may attach first and second adjacent lengths comprising adjacent first and second loops of the strand together. In this case, the first and second lengths may correspond to respective first and second adjacent cycles in a helically progressive pattern forming a non-concertina barbed tape product.

The attachment elements may be positioned in a predetermined pattern on the strand forming the continuous coil. The pattern may be a repeating pattern and provide a predetermined natural configuration of the product when the product is stretched out in a deployed state of use. For example, the pattern may provide a donut or a ball configuration when the product is stretched out in a deployed state of use.

In another aspect, the invention may include one or more attachment elements for holding two adjacent strands of barbed tape concertina product together. The attachment element may include a generally U-shaped staple structure having a central base and a plurality of arms extending from opposite ends of the base in a common direction transverse to the base. The base may have a length between the ends of approximately 0.410+/−0.0325 inches or 0.410+/−0.10 inches or 0.410+/−0.00 inches.

The one or more attachment elements may include one arm supported on one end of the base and a pair of arms supported on the other end of the base for an interleaved configuration when attaching two loops of the strand together. A distance between the one arm and the pair of arms may be approximately 0.290+/−0.0325 inches, 0.290+/−0.010 inches or 0.290+/−0.00 inches to generally match the length of the base.

In still another aspect, the one or more attachment elements may include a plurality of like attachment elements. The attachment elements may further include one or more slits extending from end to end in the base of each attachment element. In one case, the slits may be a pair of slits. A filament may be held in each of the slits. The filament that is held in each of first slits may be a first common filament and may hold the attachment elements together with the first slits of each attachment element aligned with each other. The filament that is held in each of second slits may be a second common filament and may hold the attachment elements together with the second slits of each attachment element aligned with each other. Each of the first and the second common filaments may comprise a nylon material and may be held in respective first and second slits by a compression fit. It is to be appreciated that a single slit and a single filament in the slit may be used in the same way as a plurality of slits and elements.

A material of the attachment element proximate the slits may be work hardened so that the one or more attachment elements may have a strength greater than or equal to a strength of an attachment element without slits. This work hardening effect may be provided by a variety of different processes including, but not limited to, a punching process during formation of the slits, by a crimping step when forming the compression fit, or by both.

The present invention relates to a system and method of forming a barbed tape product. The method may advantageously include programming an electronic controller for automatically forming, coiling and attaching loops and pairs of loops of the product together. In particular, the method includes programming the controller for automatically forming a strand of the product in a machine. The controller is also programmed to coil the strand of product into loops of a predetermined radius and to attach adjacent loops of the product together at predetermined attachment points along the strand of product. The method includes operating the machine under control of the electronic controller to complete the operational steps of forming, coiling, and attaching the strand of product.

The step of attaching may include connecting a first pair of adjacent loops together by a clip at a first predetermined circumferential position on the coils and connecting a second pair of adjacent loops together by a clip at a second predetermined circumferential position on the coils circumferentially spaced from the first position. The first pair of loops may be adjacent to the second pair of loops. The method may further include the step of connecting individual adjacent loops together by at least one additional clip in at least one helically progressive circumferential position between the first position and the second position. Alternatively, the method may include the step of connecting the individual adjacent loops together by a plurality of additional clips between the first position and the second position in a helically progressive pattern.

In accordance with the method, the strand of product may form a coil having a first predetermined length comprising a plurality of adjacent loops. The step of programming for automatically attaching may include programming the electronic controller for attaching in a predetermined pattern of attachment points along the strand of product. Furthermore, the step of operating the machine to complete the operational step of attaching may include connecting adjacent loops together by clips at predetermined helically progressive circumferential positions in accordance with the predetermined pattern.

While the present method implemented to form a concertina product will typically involve attaching adjacent loops of directly together by clipping, a method of forming a barbed tape product of the present invention may also include forming non-concertina products. This is done by similarly programming an electronic controller for automatically connecting adjacent loops together at predetermined positions along the strand of product and by operating the machine under electronic controller control to connect a first loop to a second loop by a spacer line. It is to be understood that the spacer line may be a wire or a ribbon, for example. This line may be formed of any of a variety of materials including, but not limited to cables or extrusions of plastics, metals, and/or fabric. The first and second loops may be connected to each other by attaching the spacer line to a first attachment point at a first predetermined circumferential position on the first loop and attaching the spacer line to a second attachment point at a second predetermined circumferential position on the second loop. Thus, the first and second loops may form at least a portion of the coil, and the first and second attachment points may be circumferentially spaced from each other on the coil. The first loop may be adjacent to the second loop, or the first and second loops may have intervening loops therebetween.

The method may further comprise the steps of connecting the adjacent loops to each other by one or more additional spacer lines attached to additional respective first and second attachment points on the first and second loops in helically progressive circumferential positions on the loops. As described above, the first and second attachment points of the first loop may be circumferentially offset relative to the first and second attachment points of the second loop.

In a simple form the method of forming a barbed tape product may include forming the product into a helical coil and automatically attaching at least one object to a strand of the coil under the control of an electronic controller. The method may further include automatically attaching a plurality of objects to the strand of the coil. The plurality of objects may include a plurality of similar objects and/or a plurality of dissimilar objects. These objects may include a plurality of lines.

The method may further include automatically attaching the plurality of lines at a plurality of attachment points on at least one loop of the coil. The method may also include attaching each of the plurality of lines to the plurality of loops at the plurality of attachment points on the plurality of loops of the coil. The step of attaching each of the plurality of lines at the plurality of attachment points may include attaching each of the plurality of lines to the plurality of loops at circumferentially spaced locations on the coil. Furthermore, the method may further include attaching the plurality of lines at a first set of attachment points on a first length of the coil and attaching the plurality of lines at a second set of attachment points on a second length of the coil so that the second set of attachment points is offset relative to the first set of attachment points. For a roll of barbed tape product, the method may include alternatingly attaching the plurality of lines at respective first sets of attachment points on a plurality of first lengths and at respective second sets of attachment points on a plurality of second lengths, and alternating the first and second lengths in a helically progressive pattern along the strand of the coil.

The step of attaching the plurality of objects may include attaching at least one fastener and at least one line. The line may be one or more of each of a spacer line, a trip line, and/or a sensor line. The step of attaching a plurality of objects may additionally or alternatively include attaching at least one marker. The step of attaching a plurality of objects may include attaching at least one clip. It is to be understood that the lines and other objects may be attached by clips or other fastening mechanisms. These fastening mechanisms may include an integral structure of the objects themselves.

The step of attaching the plurality of objects may include attaching the plurality of objects by a single device attached to a take up reel. Alternatively, the step of attaching the plurality of objects may include attaching the plurality of objects by a plurality of devices attached to a take up reel. The step of attaching the plurality of objects may include attaching at least one of the objects inside the coil and/or another of the objects outside the coil. The step of attaching the plurality of objects may also include attaching a first set of objects in a first pattern and a second set of objects in a second pattern. In fact, any number of different or similar patterns may be applied to any number of objects to be attached to the coil generally simultaneously. It is to be understood that the patterns may be adjusted to provide attachment of the various objects in a simultaneous or a sequential manner.

A machine for automatically making a barbed tape product in accordance with the present invention may include an electronic controller operatively connected to an attachment device in the machine for automatically attaching at least one object to at least one predetermined position on the barbed tape product under electronic control to form a roll of the barbed tape product. The object may be a clip or other fastener for merely attaching one loop of the product to another. In a simple form, the machine may automatically make barbed tape by an attachment device and electronic controller that are configured to variably attach the at least one object to the barbed tape product at a predetermined attachment point corresponding to a predetermined position under electronic control.

The machine for automatically making barbed tape may be configured to attach a plurality of objects to the barbed tape product. In this regard, the machine and the electronic controller may be configured to provide a first set of the attachment points for the plurality of objects in a predetermined first pattern for a first roll of the product and a second set of the attachment points for the plurality of objects in a predetermined second pattern for a second roll of the product. The patterns may be selectively varied from the first set to the second set.

The machine for automatically making barbed tape may be configured for attaching the plurality of similar or dissimilar objects. The attachment device may have a plurality of attachment mechanisms configured for respectively attaching the plurality of objects to the barbed tape product. The electronic controller may be configured to provide a first set of attachment points for a first attachment mechanism of the attachment device and a second set of attachment points for a second attachment mechanism of the attachment device. On the other hand, the attachment device may be a first attachment device and the machine may further include at least a second attachment device configured for attaching respective first and second objects of the plurality of objects. It is to be understood that the first and second attachment devices may be similar or dissimilar devices and may be configured for attaching similar or dissimilar objects. Furthermore, any number of additional attachment devices may be provided for attaching additional similar or dissimilar objects to the barbed tape product under control of the electronic controller. Still further, the electronic controller may be configured to provide a first set of attachment points for a first attachment device and a second set of attachment points for the second attachment device. Alternatively or additionally, the electronic controller may be configured to provide respective sets of the attachment points for attaching the plurality of objects in predetermined patterns for a roll of the product. The respective patterns may be varied within the roll.

The resulting products and the attachment elements used in forming such products are the subject of a U.S. patent application Ser. No. 10/959,531 by the same Applicant as this Application, entitled "BARBED TAPE PRODUCT WITH A PREDETERMINED PATTERN OF ATTACHMENT POINTS AND ATTACHMENT ELEMENTS", filed Oct. 5, 2004, the disclosure of which is incorporated herein by reference.

Advantageously, the step of attaching the product may include automatically connecting loops of the product at a rate of approximately 125 attachment points in 320 seconds or less in some cases. On the other hand, the step of attaching the product may comprise automatically connecting loops of the product at a rate of approximately 125 attachment points in 300 seconds or less in other cases. In still other cases, the step of attaching the product may be implemented at an even faster rate in which the machine automatically connects loops of the product at a rate of approximately 125 attachment points in 240 seconds or less. All of these rates are an improvement over the fastest rates in the rest of the industry. Most of the industry relies upon manually attaching or clipping and believes that manual clipping is faster than automatic clipping. However, with the present invention, the above rates may advantageously enable greater efficiency in producing barbed tape concertina and other barbed tape products. Furthermore, the automation of the present invention lays the groundwork for unmanned production. That is, with the current method and system, product could be manufactured during lights out time, as well as during the day. Thus, production can be increased and efficiency can be increased simultaneously.

Still further, with the present invention, the attachment points on adjacent pairs of loops are offset relative to each other. Thus, mis-clipping has been greatly reduced or eliminated. The present system and method has eliminated the need for a person to use his or her finger to separate coils of adjacent pairs of loops for clipping. Rather, the coils are separated just the right distance by a previously attached clip that is in a closest axial position, but which is offset slightly in a circumferential direction.

With the present invention, any pattern of attaching may be implemented, and it is contemplated that any naturally lying deployed configuration of the finished barbed tape product could be provided by a corresponding attaching pattern. An advantage of providing a deployed configuration by the pattern reduces waste and facilitates the deploying process. Shapes such as donuts, letters, or even words could feasibly be provided by corresponding patterns of attaching. Attaching patterns providing deployed configurations other than generally straight line configurations with and without automation were non-existent and non-obvious prior to the present disclosure. Patterns including those providing generally straight configurations by the present automated method were also non-obvious prior to the present disclosure because the industry held that manual or hand clipping was faster and more efficient than the automation available in the industry prior to this invention.

The method of the present invention may include a step of selecting attachment point placement. This step of selecting attachment point placement may include selecting at least one frequency of the attachment point placement. The step of selecting the attachment point placement may further include selecting a plurality of frequencies for the attachment point placement. The step of selecting the attachment point placement may also include forming a dead space. This may be accomplished by changing a pattern of the attachment point placement or by skipping at least one unit in the frequency of the attachment point placement. Units in the attachment point placement frequency may be defined as one or more intervals and/or fractions of intervals, wherein an interval corresponds to a distance between adjacent sets of barbs on a strand of the product.

It is to be understood that the step of selecting attachment point placement may include a preliminary step of preprogramming the electronic controller to automatically place the attachment points. In fact, the method of forming a barbed tape product may simply include programming an electronic controller for automatically attaching adjacent loops of the product together in a predetermined pattern of positions along a strand of the product.

Advantageously, the step of programming may include programming the electronic controller to automatically vary the pattern of positions from a first roll of the product to a second roll of the product. As such, the method may also include automatically forming at least the first and the second rolls of the product and varying the pattern from the first roll of the product to the second roll of the product. Alternatively or additionally, the step of programming may further include programming the electronic controller to automatically vary the pattern of positions within a particular roll of the product and automatically forming the roll and varying the pattern within the roll under electronic control. Still further, the step of programming may alternatively or additionally include programming the electronic controller to automatically vary the pattern of positions between respective ones of a plurality of rolls. It is to be understood that varying the pattern between rolls may include suspending attachment for a predetermined length of a strand of the product. In any case, the method may include automatically forming the plurality of rolls and varying the pattern for the length of the product between the respective rolls.

The present invention also includes a machine or system of machines for automatically making barbed tape product. The machine or system may advantageously include at least one roll former, a radial bender, a take up device, an attaching device, and/or an electronic controller. The attaching device may be configured to automatically attach adjacent loops of product together at predetermined attachment points. The electronic controller may be programmed or configured to provide a first set of attachment points in a predetermined pattern for a first roll of product. The pattern may be varied between the first set and a second set of attachment points corresponding to a second roll. As may be appreciated, the pattern may be varied from the first set to the second set by programming the electronic controller accordingly. Alternatively or additionally, the pattern may be varied for short periods between sets to advantageously reduce or eliminate the need to rethread the product strand or to restart the machine between rolls of the product.

It is to be understood that the attaching device may advantageously comprise a clipping device such as a clipping gun and anvil. However, other attaching devices may be implemented without departing from the spirit and scope of the invention. Even twisted wire could be used to attach adjacent strands of product to each other in a concertina or other fashion. Some aspects of the invention are the ability to control the pattern of attachment, the ability to vary the pattern of attachment, and the ability to produce the product automatically with a predetermined pattern of attachment points. To this end, it is to be understood that the electronic controller may be in any one of a variety of forms including, but not limited to, a computer, a programmable logic controller (PLC), or other digital programmers (including those used in NCC applications).

The present invention relates to a tape product having a concertina coil and at least one of an internal truss and external truss connected to the coil at a plurality of connection points. The truss may advantageously strengthen and/or stabilize the coil.

A plural coil tape products may include a first concertina coil extending from a first end to a second end of the coil along a first coil axis and at least a second concertina coil extending generally from a first end to a second end of the coil along a second coil axis. The second concertina coil may intersect the first concertina coil in at least partially overlapping side by side relation in a first intersection along the first and second coil axes. The first intersection may comprise a connection of the second concertina coil at more than one circumferentially spaced connection points on the first coil. The product may likewise include intersecting connections to additional coils.

The invention also encompasses a shaped concertina tape product having a concertina coil forming an envelope of a predetermined configuration. The product may include a plurality of trusses connected to the coil. The coil may be thus rigidified against forces in one or more direction so that in a deployed state, an original dimension of the envelope in a rigidified direction is maintained while a dimension in a non-rigidified direction is reduced.

A deployment system for deploying and retrieving a concertina tape product may include a product magazine having at least one base, a stanchion supported on the base, and a latch mounted on the stanchion. The stanchion may have an upright member extending upwardly from a first end of the base and a cantilever support member with a first end connected to the upright member and a second end extending in overlying relation to the base toward a second end of the base. The cantilever support member may have a connection structure at the second end of the cantilever support member for selectively receiving a gooseneck member. The gooseneck member may be removeably connected at a first end of the gooseneck member to the connection structure in one of at least two configurations.

In a simple form, the product may be a plural coil tape product that includes a first coil extending from a first end to a second end of the coil along a first coil axis. The product thus configured may include at least a second coil extending generally from a first end to a second end of the coil along a second coil axis. The second coil may intersect the first coil in at least partially overlapping side by side relation in a first intersection along the first and second coil axes. The first intersection may form an internal truss that includes portions of the first and second coils. Thus, a respective plurality of similarly formed internal trusses may generally form a repeating pattern of upright ovals along the first and second coil axes when viewed from a side in a deployed state. In accordance with this configuration, the internal truss and a respective plurality of similarly formed internal trusses may generally form a zig zag pattern along the first and second coil axes when viewed from above in a partially deployed state. Also, the internal truss thus formed may form a generally upright linear configuration as viewed from an axial end with the product in a fully deployed state. It is to be understood that the product in this configuration may further include a third coil intersecting the first and second coils in at least one circumferential position of each of the first and second coils.

The foregoing and other features and advantages of the present invention will be apparent from the following more detailed description of the particular embodiments of the invention, as illustrated in the accompanying drawings.

BRIEF DESCRIPTION OF THE DRAWINGS

FIGS. 15A-15H, 16A-16P, and 17A-17G are diagrammatic end views of product in various configurations;

FIGS. 18A-18B are a diagram and table showing the narrowing of the width as it relates to the stretch of the product during deployment;

DETAILED DESCRIPTION OF EMBODIMENTS OF THE INVENTION

Figure 1:
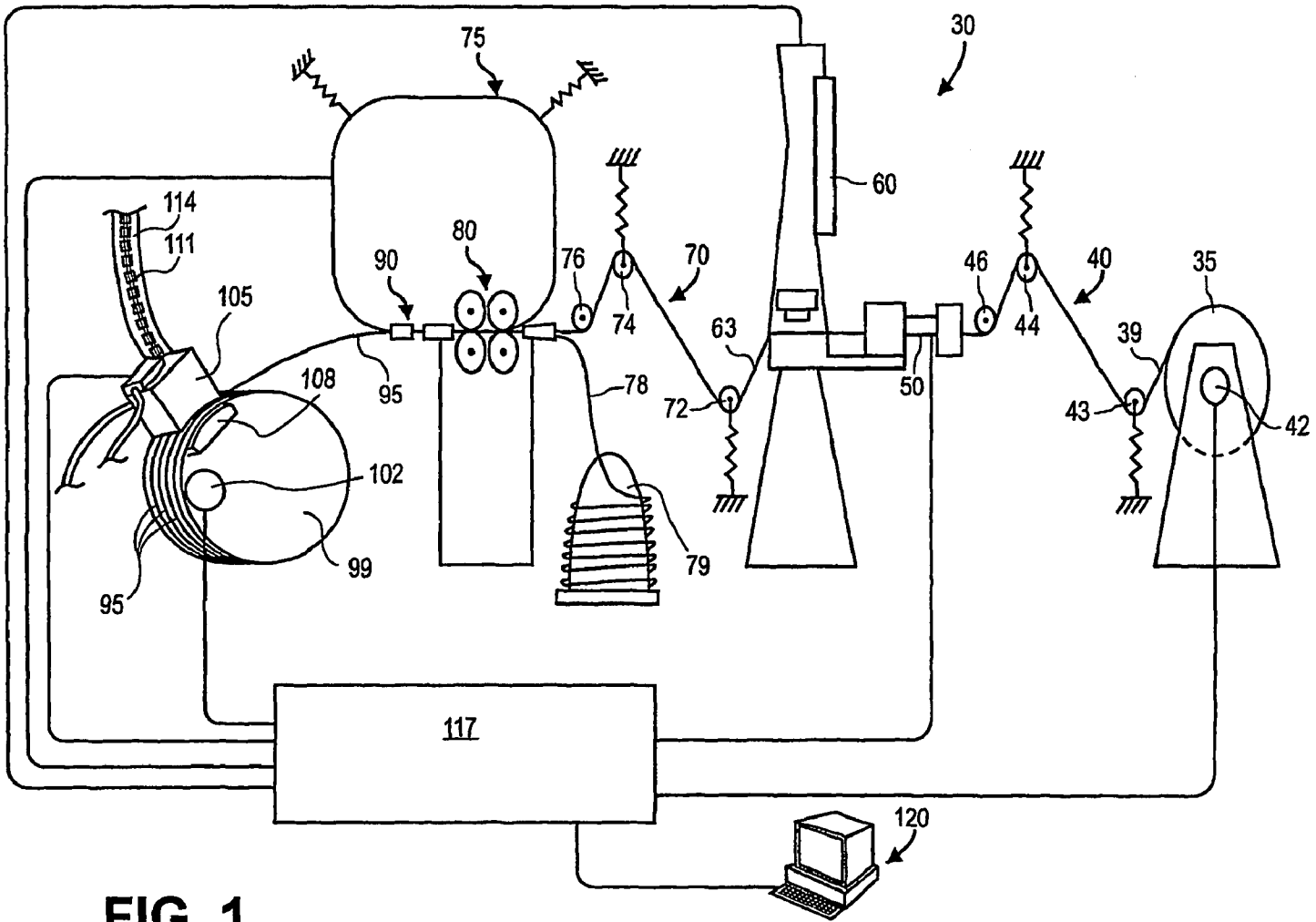
FIG. 1 is a diagrammatic view of a system in accordance with the present invention.

As discussed above, embodiments of the present invention relate to a system and methods of forming a barbed tape product, and are directed more particularly to the product formed by the system and methods. For example, FIG. 1 is a diagrammatic view of a machine or system of machines 30 for forming a barbed tape product in accordance with the present invention. As such, the system includes a spool 35 of tape 39 in the form a thin flat tape stock material. The spool 35 may be automatically turned by a motor 42. The tape 39 is guided through a shock absorbing portion of the system that includes guide rollers 43, 44, and 46. Then a feed device 50 moves the tape 39 into a blanking press 60. The blanking press 60 forms barbs on the tape 39. Thus, a barbed tape 63 is guided by idlers 72, 74, and 76 into a forming station 75 from a reel 79. In the forming station 75, a roll former 80 forms the barbed tape 63 at least partially around the wire 78 to form an integral barbed tape product. The barbed tape product is moved forward through the system into a radial bender 90. The radial bender 90 provides a continuous bend into the barbed tape product so that the barbed tape product is biased into coils. The coils are subsequently wound into rolls corresponding generally to the size of the coils for further processing, storage, shipping, and dispensing. Hence, as the barbed tape product leaves the radial bender 90 and the forming station 75, it does so as a radially bent single strand of barbed tape product 95.

This strand of barbed tape product 95 is received on a take up reel 99. The take up reel 99 may have a motorized product pulling paddle 102 for moving the strand of product 95 circumferentially around the take up reel 99. A clip gun 105 and an anvil 108 are disposed on radially opposite sides of product strands 95 on the take up reel 99. A string of interconnected clips 111 are fed into the clip gun 105 by a clip slip 114. The clip gun 105 is pneumatically, hydraulically, or otherwise powered to automatically and repeatedly clip adjacent strands 95 together in a predetermined pattern as will be described in greater detail below.

Advantageously, an electronic controller 117 is integrated with the system 30. The electronic controller 117 may be preprogrammed via a programming device 120. The programming device 120 may remain connected to the electronic controller or may be removed once the electronic controller 117 has been programmed. As shown in FIG. 1, the electronic controller is operatively connected to the various portions or machines within the system 30 in order to synchronize the operation of the various portions with each other. For example, the electronic controller may be operatively connected with the stock tape reel motor 42, the feed device 50, the blanking press 60, the forming station 75, the motorized paddle 102 of the take up reel 99, and the automatic clipping gun 105. Thus the system 30 can automatically form, coil, and attach adjacent loops of the product strand 95 under the control of the electronic controller 117.

Figure 2A:
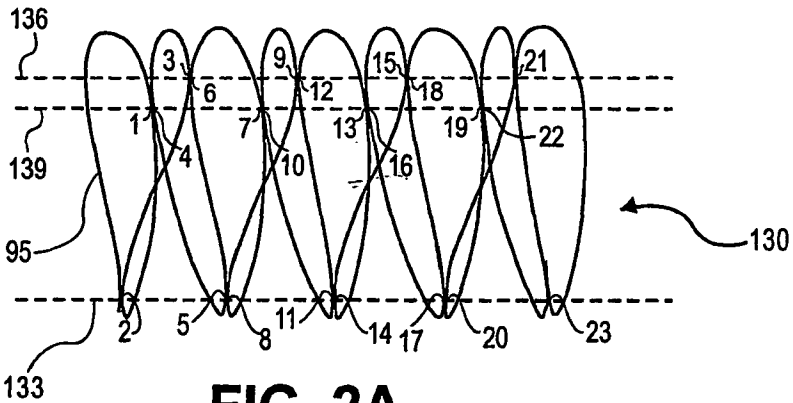
FIG. 2A is a diagrammatic side view of a segment of product having a standard concertina configuration.

FIG. 2A is a diagrammatic side view of a deployed segment 130 of barbed tape product in a standard concertina configuration. As such, attachment points are formed generally along an odd number (in this case three) of axially extending and circumferentially spaced lines 133, 136, and 139. A first axially extending line 133 is disposed near a base of a deployed segment 130 of the product. A second axially extending line 136 is disposed generally at an upper rear position on the segment 130. A third line 139 is disposed in a generally forward and upward position on the segment 130. In a standard concertina configuration, the attachment points are generally equally circumferentially spaced from each other. In order to achieve the concertina configuration, the product strand 95 is attached to adjacent strands in the helical coil of the product 130 in a predetermined manner. Specifically, the strand 95 is attached to itself at attachment points on lines 133, 136 and 139 in a helically progressive pattern as will be described below.

The segment 130 of FIG. 2A is a right-handed helix to the right. Thus, the strand 95 progresses in a clockwise direction toward the right as viewed from the left. By numbering points on the strand 95, which form part of the attachment points, in a helically progressive manner, a helically progressive pattern of attachment can be recognized. Thus, starting at a point labeled 1 in FIG. 2A and moving in a clockwise direction to the right the strand 95 reaches a second attachment point labeled 2 with a next rearwardly adjacent loop on line 133. Progressing in a clockwise direction from the point labeled 2 on the strand 95 to the point labeled 3, at which the strand 95 is connected to the next forwardly adjacent loop on line 136, starts a repeating pattern of attachment. The pattern in this case is that the strand 95 is attached to a next rear adjacent loop at a third of the distance around the circumference and then attached to a next forwardly adjacent loop after another third of the distance around the circumference. After the third of travel in a clockwise direction a forth point on the strand 95 labeled 4 forms an attachment point with the next rearwardly adjacent point, which is also labeled 1. This pattern of attachment to alternating forward adjacent and rearward adjacent portions of the strand 95 is repeated throughout the segment 130. The result is a product 130 that can be deployed in a concertina configuration. Since the attachment points lie generally on the equally spaced lines 133, 136 and 139, and the pattern is a consistently repeated pattern, the product 130 will naturally form a straight line configuration when deployed.

While the configuration shown in FIG. 2A may be advantageously manufactured in accordance with the present invention, and the predetermined pattern may be provided automatically under control of the electronic controller, the placement of the attachment points in FIG. 2A may be located differently as described below with regard to FIGS. 2B through 6B below.

Figure 2B:
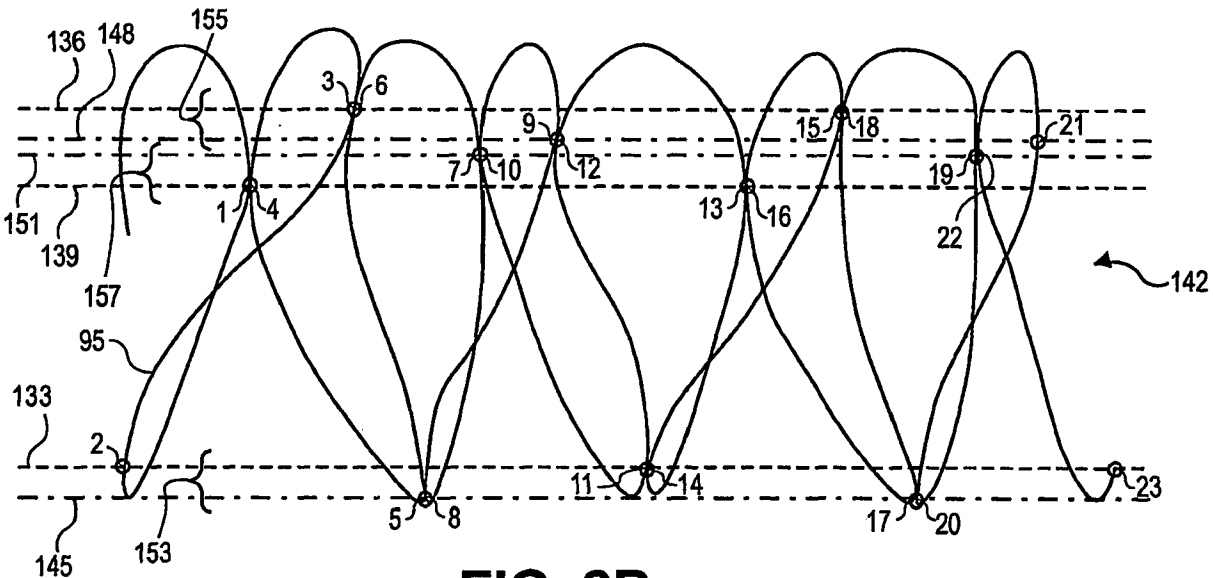
FIG. 2B is a diagrammatic side view of a modified concertina configuration in accordance with the present invention.

As shown in FIG. 2B, lines 133, 136 and 139 correspond to those shown in FIG. 2A labeled with the same numerals 133, 136, and 139. Sets of attachment points disposed generally on these lines 133, 136, and 139 are disposed generally equally spaced about the circumference of the segment. However, FIG. 2B shows a segment 142 having a different configuration of attachment points. In this case, three additional lines are defined as offset lines 145, 148 and 151. The offset lines 145, 148 and 151 are offset from lines 133, 136 and 139 by a predetermined circumferential distance. Lines 133 and 145 form a first pair of lines 153 located generally at a bottom of segment 142. Lines 136 and 148 form a second pair of lines 155 located generally at an upper rear of the segment 142. A third pair of lines 157 provide a third pair of lines 139, 151 located generally at an upper front of the segment 142.

The helical aspect of the segment 142 in FIG. 2B progresses in a clockwise direction to the right. As described with regard to FIG. 2A above, the attachment pattern progresses by the strand of product 95 being attached first to the next rearwardly adjacent loop and then to the next forwardly adjacent loop and so forth in a helically progressive manner. As shown in FIG. 2B, one full loop is formed by the product strand 95 as it progresses from a point 1 on the strand 95 to a point 4 on the strand. As may be appreciated, all of points 1 through 4 are located on lines 133, 136, and 139, which are not offset. The next coil in the helically progressive pattern is formed by the product strand as it progresses from the point 4 to the point 7 on the strand. However, it is to be noted that point 5 is located on offset line 145. Likewise, point 7 is located on offset line 151, and the second coil is just short of a completely circumferential coil of 360 degrees by the circumferential distance of the offset. A third coil is provided as the strand 95 of product progresses from point 7 to point 10. As may be appreciated, the third coil is very similar in appearance to the first coil. However, each of points 7, 8, 9, and 10 are located generally on the offset lines 145, 148, and 151.

By following the same helically progressive pattern, the fourth coil transitions back to attachment points on the non-offset lines 133, 136 and 139. The result of this progressive pattern is that each subsequent attachment point on a given pair of lines 153, 155, 157 is offset relative to the attachment point immediately previous thereto on that pair. This arrangement has important manufacturing benefits. In particular, offsetting the attachment points in this manner reduces or eliminates mis-clipping by a clipping gun such as that shown in FIG. 1. This is due to the fact that the immediately previous clip on a pair of lines is not circumferentially aligned with the attachment point at which a subsequent clip is to be applied by the clipping gun.

Figure 3:
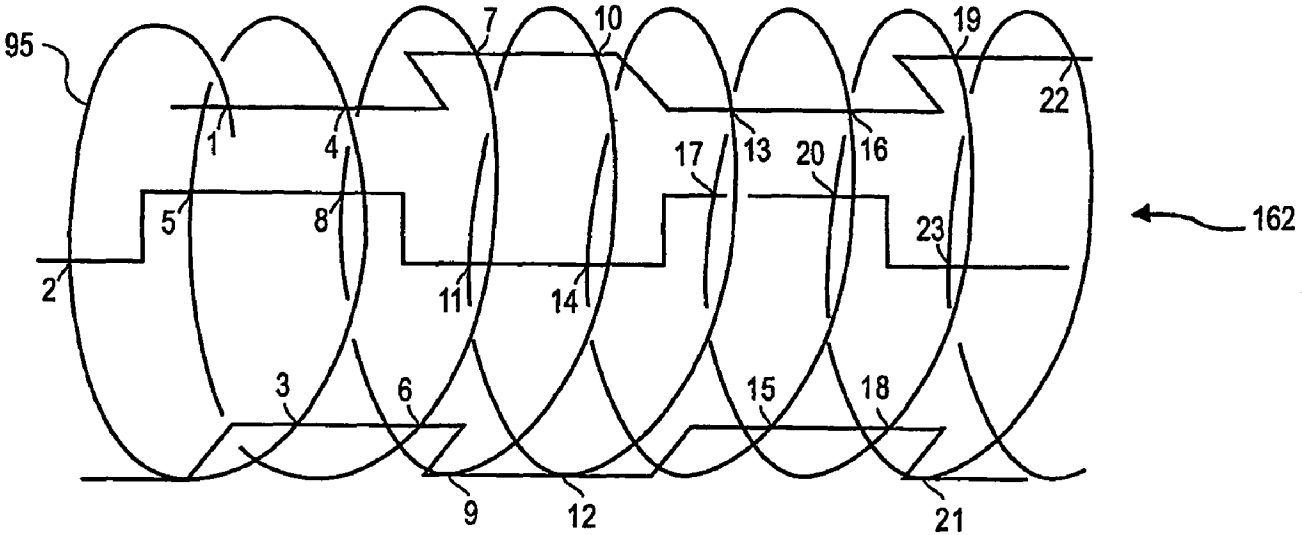
FIG. 3 is a diagrammatic perspective view of a helically coiled barbed tape product depicting attachment points required to achieve the concertina product of FIG. 2B.

With regard to FIGS. 2B and 3, it is to be understood that an attachment point on a first pair of product loops will be circumferentially offset relative to an attachment point of an adjacent second pair of loops that would have otherwise been circumferentially aligned in the standard concertina product. Furthermore, an attachment point of the first pair of loops will also be offset relative to every other attachment point of the adjacent second pair of product loops. This is somewhat challenging to see when the concertina product is stretched and deformed into its deployed configuration as shown in FIG. 2B. However, it is more easily seen in the undeformed helical configuration shown in FIGS. 3 and 4.

Figure 4:
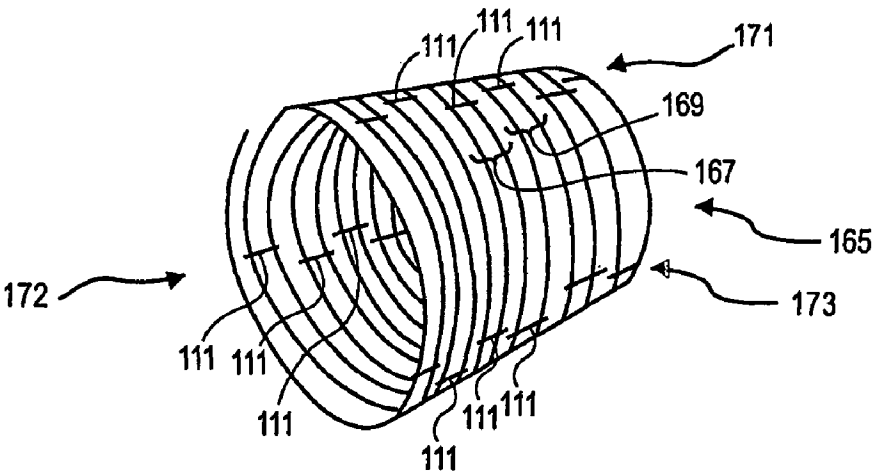
FIG. 4 is a diagrammatic perspective view of the segment of FIG. 3 in a contracted and clipped state.

FIGS. 3 and 4 provide alternative illustrations of how the offset attachment points are distributed on the segment 162, 165 in a non-deformed configuration. Segments 162 and 165 progress in counterclockwise directions to the right. However, the pattern of attachment is substantially similar to that shown and described with regard to FIG. 2B above. For example, attachment point 1 on the product strand 95 is attached to the next forwardly adjacent loop at 4 as indicated by the straight line connecting 1 and 4 in FIG. 3. Next, the strand 95 is connected to a rearwardly adjacent loop at point 2 on the strand. By following the strand helically forward to the right, it can be seen that a point 3 on the strand 95 is attached to the next forwardly adjacent loop at a point 6 on the strand. Then a point 4 on the strand 95 is connected to the next rearwardly adjacent loop at 1. Point 5 is connected to the next forwardly adjacent loop. Point 6 is attached to the next rearwardly adjacent loop. This pattern is implemented in a helically progressive pattern for a complete roll or the segment 162 thereof to provide the pattern of offsets shown by the stepped lines in FIG. 3.

FIG. 4 shows a resultant roll 165 of product in a rolled non-deployed state in accordance with the present invention. As shown, the clips 111 are circumferentially offset relative to each other from one pair of loops 167 to an adjacent pair of loops 169 in a particular circumferential region 171. As may be appreciated, the same is true for clips 111 attached to adjacent pairs of loops in each of the other circumferential regions 172 and 173 shown in FIG. 4. Alternatively described, each pair of loops has one or more attachment points in which first attachment points of a plurality of pairs of loops correspond to each other. In concertina products the number of attachment points for a pair of loops is regularly an odd number and is typically provided in a repeating pattern. In this way, a first attachment point of one pair of loops generally corresponds in position to first attachment points in the other pairs of loops, a second attachment point generally corresponds in position to second attachment points, and a third attachment point generally corresponds to third attachment points. As such, circumferential regions may be defined as regions corresponding in number to the number of attachment points per pair of loops. The circumferential extent of the regions may therefore be 360 degrees divided by the number of attachment points on a pair. The circumferential regions may include areas extending generally equal circumferential distances on each side of respective attachment points. However, when the attachment points of adjacent loops are offset relative to corresponding attachment points in adjacent pairs of loops, then the region may be defined as extending equal circumferential distances from an average circumferential position along a roll of the product.

Figure 5A:
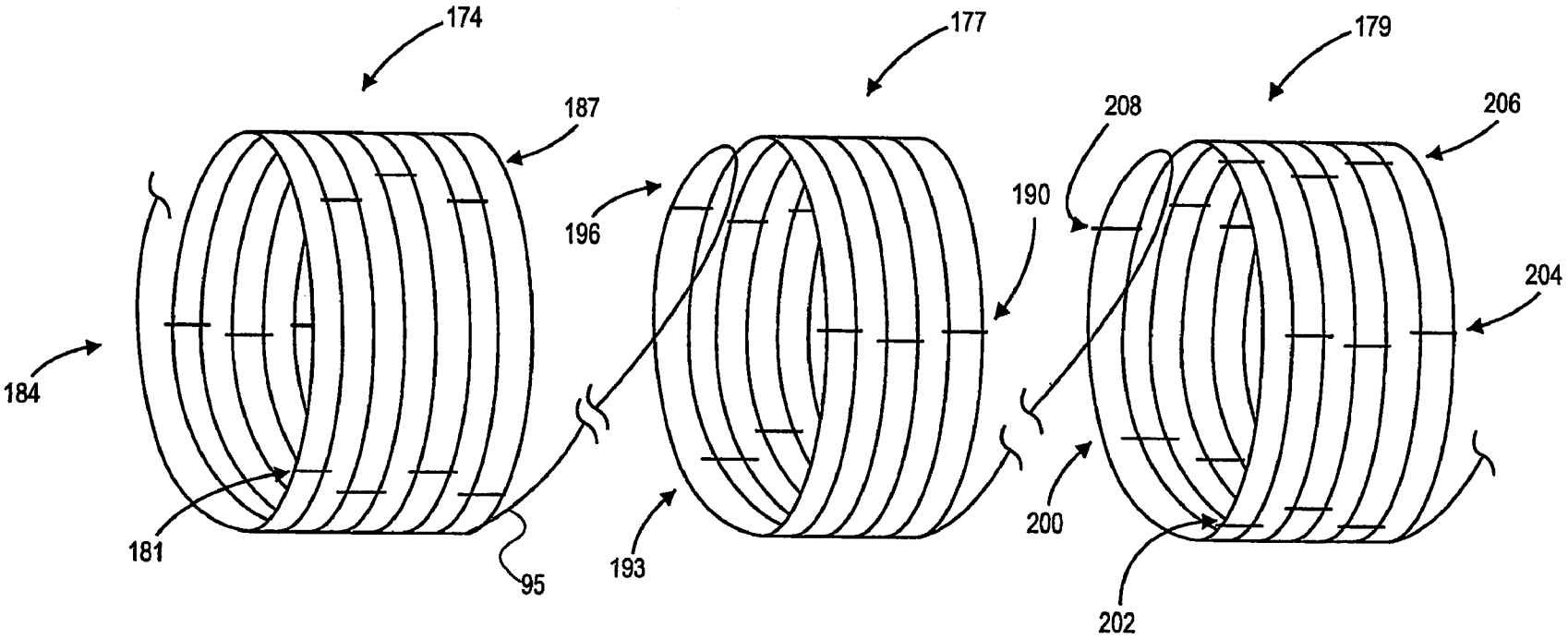
FIG. 5A is a diagrammatic perspective view showing how the pattern of attachment points can be varied from one roll to another.

FIG. 5A shows rolls of product 174, 177, and 179, which may be produced by a system of the present invention. Each of the rolls 174, 177, and 179 have a corresponding set of attachment points. The set of attachment points is programmed into the electronic controller as described previously. These rolls 174, 177, and 179 may be produced in sequence. That is, the electronic controller may be programmed to produce one roll after another with the attachment point pattern varying from one roll to the other. Alternatively, the pattern may be the same for each roll. However, the pattern may be interrupted between rolls. As shown in FIG. 5A, a length of the product strand 95 between the rolls may extend a predetermined distance without clipping by the system. The capability of the system to be preprogrammed in this manner enables continuous production without having to stop the machine for re-threading. As shown, attaching regions 181, 184, 187 may be evenly distributed circumferentially as shown on the roll 174. Regions 190, 193, and 196 may be distributed unevenly about the circumference as shown on roll 177. Any odd number of regions of attachment points may be distributed about the circumference of a roll in order to achieve a concertina configuration. For example, five regions 200, 202, 204, 206, and 208 are shown on roll 179. The number and distribution of these regions shown in FIG. 5A is exemplary only. It is to be understood that any number of regions and any variation of positions for the regions is considered to be within the spirit and scope of the present invention.

Figure 5B:
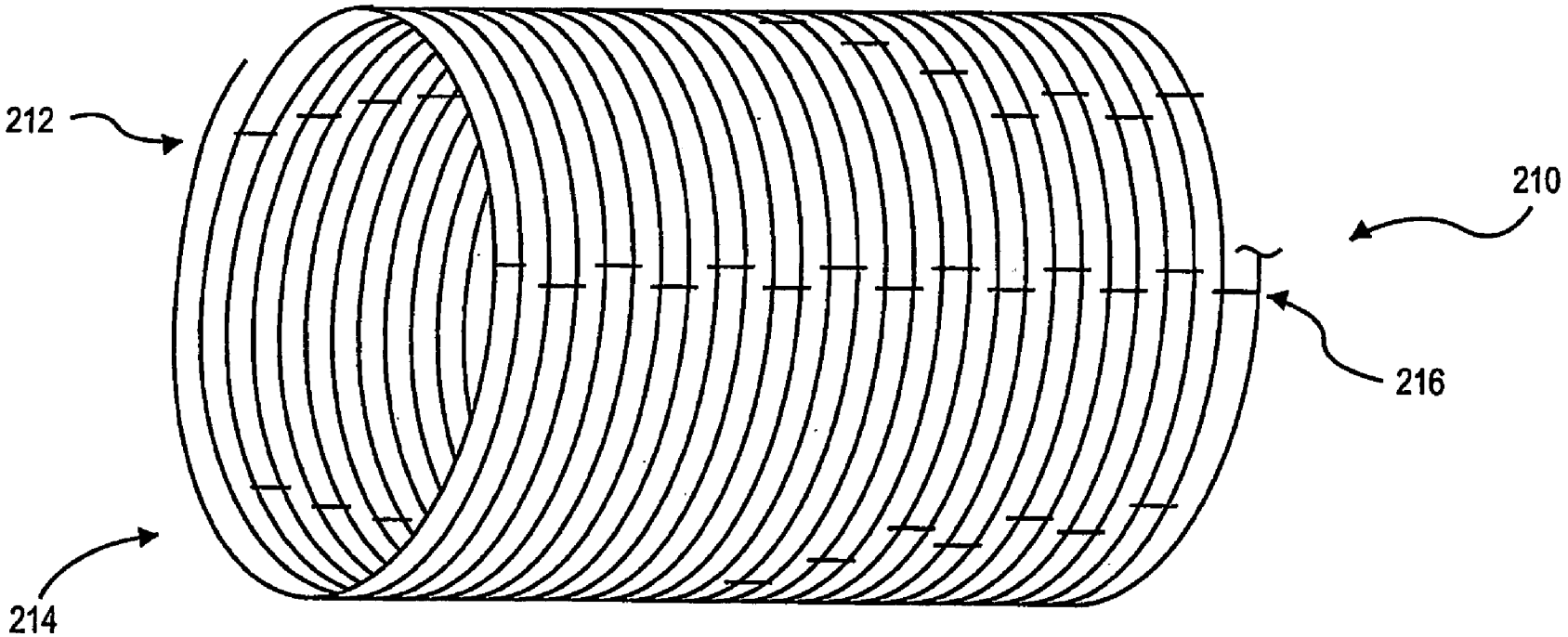
FIG. 5B is a diagrammatic perspective view showing how the pattern of attachment points can be varied within one roll.

Furthermore, as shown in FIG. 5B, the pattern of the attachment points may be varied within a given roll. For example, a roll 210 has a first region 212 and a second region 214 which progress from positions on a rear portion of the roll 210 to positions on a front of the roll in a helically progressive pattern to the right. It is to be understood, that the pattern programmed into the electronic controller and applied to a roll of product such as roll 210 determines the shape in which the product will naturally lie in a deployed state. For example, the right most portion of the roll 210 having attachment points of all 3 regions on the front of the roll 210 will tend to cause the roll to bend out of the page and to the right, as viewed, when the roll is stretched out and placed in its deployed state.

With this in mind, it is to be understood that the electronic controller can be programmed to produce rolls that will provide donut shapes in their deployed states. Alternatively, a roll may be formed that curves first in one direction, then progresses through a straight portion, and then curves in the other direction to form an "S" shape. Thus, the product could be made to form letters or even words in its deployed state. Such precision is made possible by the exactness with which the system of the present invention can be programmed to position attachment points. A more practical application for providing a precisely shaped or configured product may be that of matching the deployed product to a particular contour of a landscape or building structure. For example, product may be customized to extend in a line across the ground, then bend to extend up a wall, and bend again to extend across an edge of a roof.

Figure 6A:
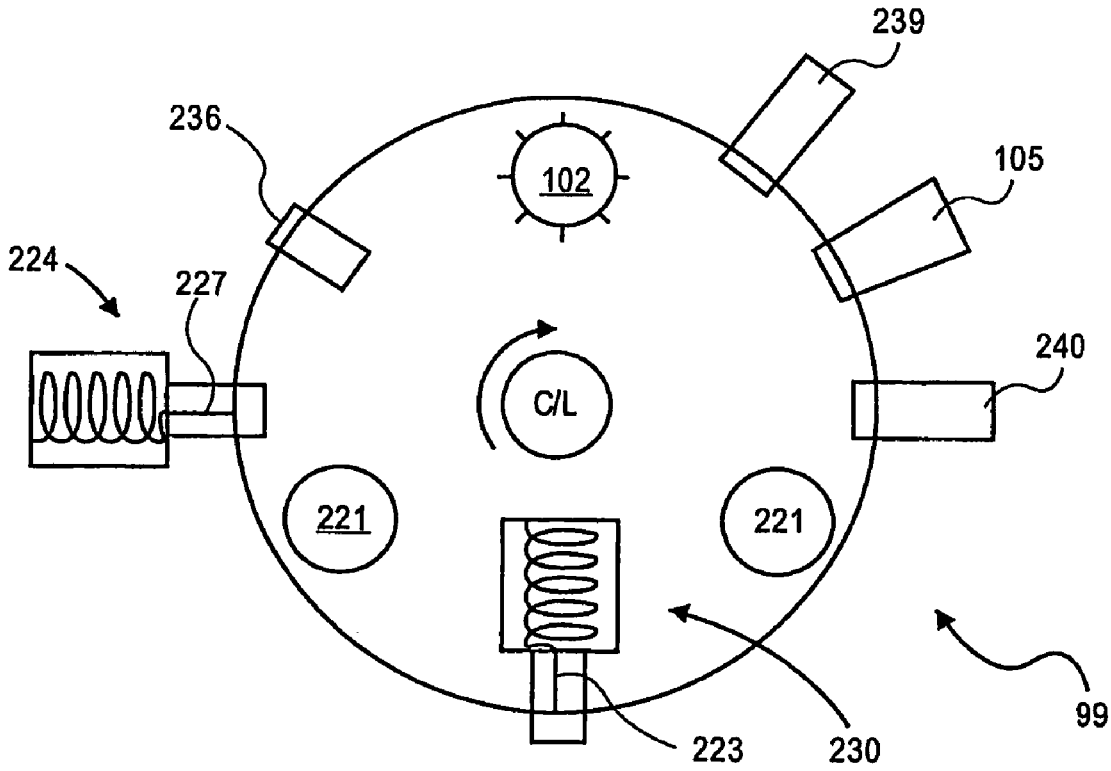
FIG. 6A is a diagrammatic view of the take up reel showing several devices supported thereon.

FIG. 6A is a diagrammatic view of the take up reel 99 with a variety of devices that may be supported thereon for attaching objects to the barbed tape product of the present invention. Element 105 represents the clipping device 105 shown in FIG. 1 and described above. Element 102 represents the motorized paddle 102 or index paddle described above. The take up reel 99 may further have rollers 221 for aiding smooth rotation of the reel 99. A line attaching device 224 may be provided for attaching a line to the product at predetermined positions under software control. The line attaching device may attach a spacer line 227 to limit separation of selected ones of the loops from each other in the deployed state. A plurality of line attaching devices may be supported on the take up reel 99 at predetermined circumferential positions around the coil of the product to form a generally uniform separation of loops of the strand on all sides of the coil when it is deployed. Alternatively, different spacing lengths of the spacer line 227 may be provided at different positions on the coil to provide a predetermined configuration of the coil in its deployed state.

Other devices may be selectively provided on the take up reel including a sensor line attaching device 230 that may be supported at a generally radially inward position on the reel for attaching a sensor or other line 233 generally on an inside of the product strand. The other line 233 or the spacer line 227 may be one of a plurality of such lines that may include, but are not limited to, spacer lines, trip lines, and/or sensor lines. It is to be understood that the sensor lines may be of any type, including but not limited to magnetic or fiber optic lines. All of these lines may incorporate any suitable material including, but not limited to, metals, plastics, or composites formed as wires, tapes, ribbons, cables, or ropes, for example. The reel 99 may also have a tab inserting device 236 supported thereon for attaching tabs or flags to the strand of product at predetermined positions.

As described above with regard to the attachment points and attachment elements 111, the spacer lines, trip lines, sensor lines, and tabs may be attached at any predetermined positions on the product strand. Furthermore, it is to be understood that these positions may be varied within a roll or unit 373, 385 of the product, or may be varied from one roll to another. As shown, a cut off device 239 may be provided separately from the attaching device for cutting the product at a predetermined position. Alternatively, the cut off device may be provided integrally with the attaching device 105. Furthermore, it is to be understood that one or more of the line attaching devices 224, 230 could be provided integrally with the attaching device 105. In fact, any number of the attaching device 105 and the other devices may be integrated together as attachment mechanisms of an overall device or may be provided separately without departing from the spirit and scope of the invention. It is also to be understood that any number of additional devices such as auxiliary device 240 may be provided on the take up reel to treat the strands of product or attach additional objects in any manner desired to provide a variety of functions to the product. For example, motion sensors or microphones could be attached to the product at selected locations.

Figure 6B:
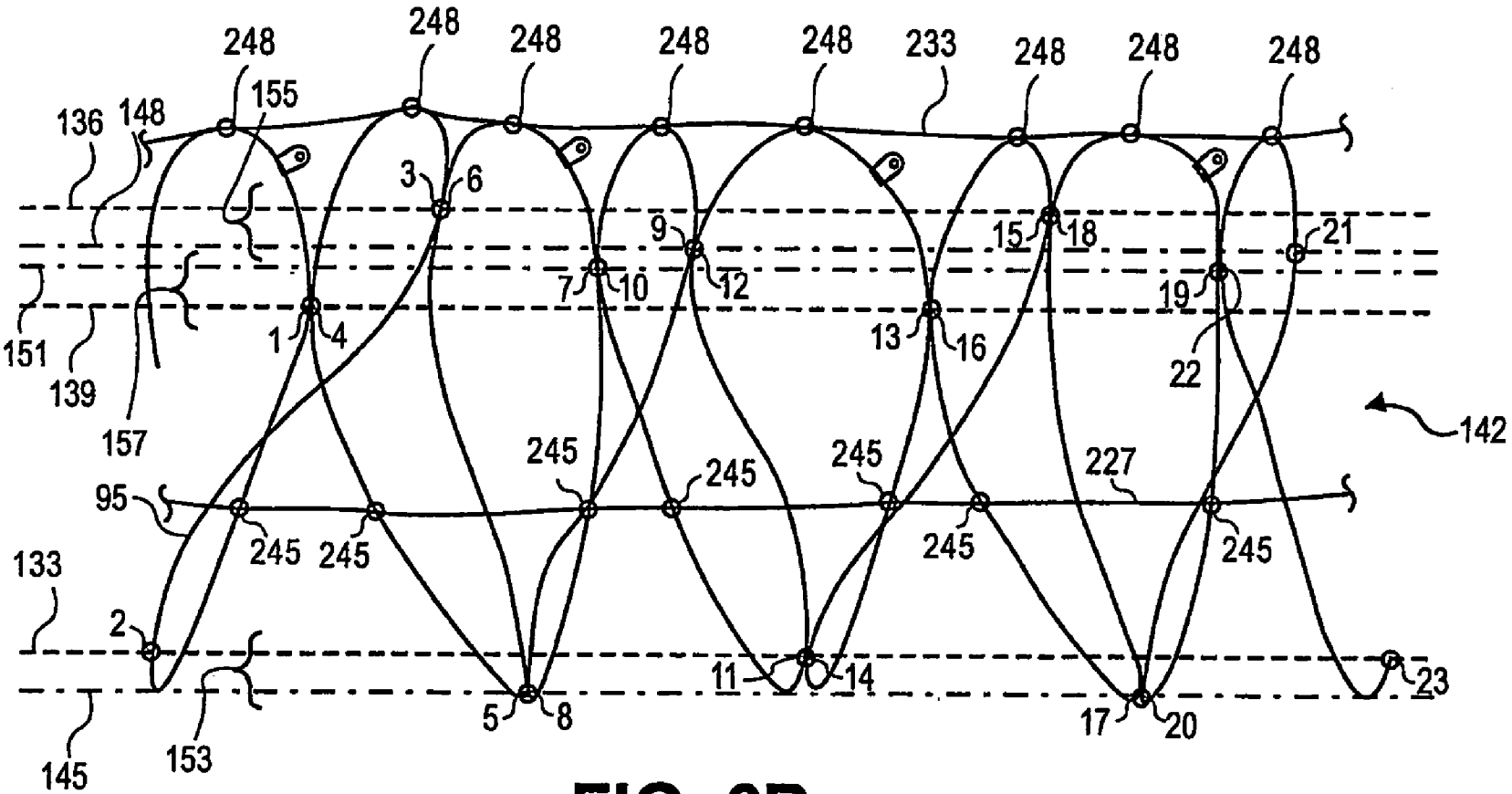
FIG. 6B is a perspective view of a non-concertina barbed tape product having objects attached at various circumferential positions in accordance with the present invention.

FIG. 6B is a perspective view of a segment of barbed tape product 242 having an exemplary spacer line 227 attached to an exterior of the coil by line attachment elements 245. These line attachment elements 245 may be the same as the attachment elements 111 described above, in the co-pending U.S. application Ser. No. 10/959,531, entitled "BARBED TAPE PRODUCT WITH A PREDETERMINED PATTERN OF ATTACHMENT POINTS AND ATTACHMENT ELEMENTS", filed Oct. 5, 2004 by the same applicant, the disclosure of which is incorporated herein by reference, and in greater detail below. Alternatively, they may be attachment elements configured specifically for attaching lines. The attachment elements 111, 245 may function to both attach adjacent loops of the product together and to attach separate objects, including the spacer lines 227. FIG. 6B shows the sensor line 233 held on an interior of the coil by attachment elements 248. As may be appreciated, the spacer lines 227 and the other lines 233 may function as trip lines because they will cause the product to close in upon any intruder that engages the lines 227, 233. While shown in a relatively loose relation similar to hog rings in FIG. 6B, the attachment elements 245, 248 may form a tight crimp on the product 242 in order to hold the lines or other objects to the strand of product at the predetermined positions. Furthermore, the lines 227, 230 may be fastened by other mechanisms including by structural elements integral with the lines 227, 230 themselves, for example. Still further, the line attaching devices 224, 230 may take a form other than that of clipping guns. Axially adjacent attachment elements among each of elements 245 and, 248 may be circumferentially offset relative to each other to facilitate automatic attachment under control of the electronic controller. It is to be understood that FIG. 6B is exemplary only. It is expected that two to four spacer lines may also be attached to the product for holding the product in a uniformly distributed position in the deployed state. Also, tabs or flags 251 may be attached to the product at predetermined intervals or selected positions.

The attachment of objects including spacer lines 227, 233 shown and described with regard to FIGS. 6A and 6B may be applied to concertina products as well as to non-concertina products. A method of making a barbed tape concertina product, for example, may include attaching the spacer line at a position of every fifth clip. That is, the electronic controller could be configured to attach the spacer line 227 and then skip four clips and attach the spacer line 227 at the fifth clip. Alternatively, the product may be a non-concertina product and have the same spacing configuration. That is, with attachments at positions where every fifth clip would normally have been in a concertina product. Such an arrangement has great material saving advantages while providing uniform spacing of the loops during deployment.

Furthermore, the non-concertina product formed with spacer lines 227 has the advantage of enabling a method of deploying that is very fast and simple in accordance with the disclosure of U.S. patent application Ser. No. 10/959,530, entitled CONCERTINA TAPE PRODUCTS CONFIGURED FOR STABLE DEPLOYMENT AND RETRIEVAL, by the same inventor, filed Oct. 5, 2004; and U.S. Provisional Patent Application Ser. No. 60/589,668, entitled RAPID DEPLOYMENT BARBED TAPE AND DISPENSER, by the same inventor, filed Jul. 19, 2004, each of which is incorporated herein by reference. This method entails fixing a first end of a roll on the ground or other structure to be protected. Then a truck or other vehicle carrying the rest of the roll may be driven along a path in which the product 242 is to be deployed. A slight tension may be applied to the roll so that the product pays out at the same rate the vehicle moves away from the first end of the product until the roll is completely expanded into its deployed state. Multiple rolls may be connected together and payed out in this manner. The rolls of the non-concertina product formed in the manner described above have a helical configuration, even in the expanded deployed state. Therefore, collection of the product may be advantageously accomplished by an auger that turns and pulls the product into a collection bin. As may be appreciated, such an auger provides great collection advantages since the product is otherwise difficult to handle and especially difficult to collect. Automation of such an auger has additional advantages of increased speed and power in collecting the barbed tape product 242.

Applications for such a barbed tape products are endless. However, in an age when mankind no longer wishes to put up with the horrors of land mines, the capability of configuring barbed tape products in accordance with the present invention may prove to be a highly desirable alternative for selectively protecting large or small areas in a customizable fashion in which the product itself is a deterrent from entry into the area. Unlike land mines, the product of the present invention can advantageously be seen and avoided. On the other hand, the barbed tape products of the present invention can be configured to slow or stop the progress of any person entering an area secured therewith.

Figure 7A:
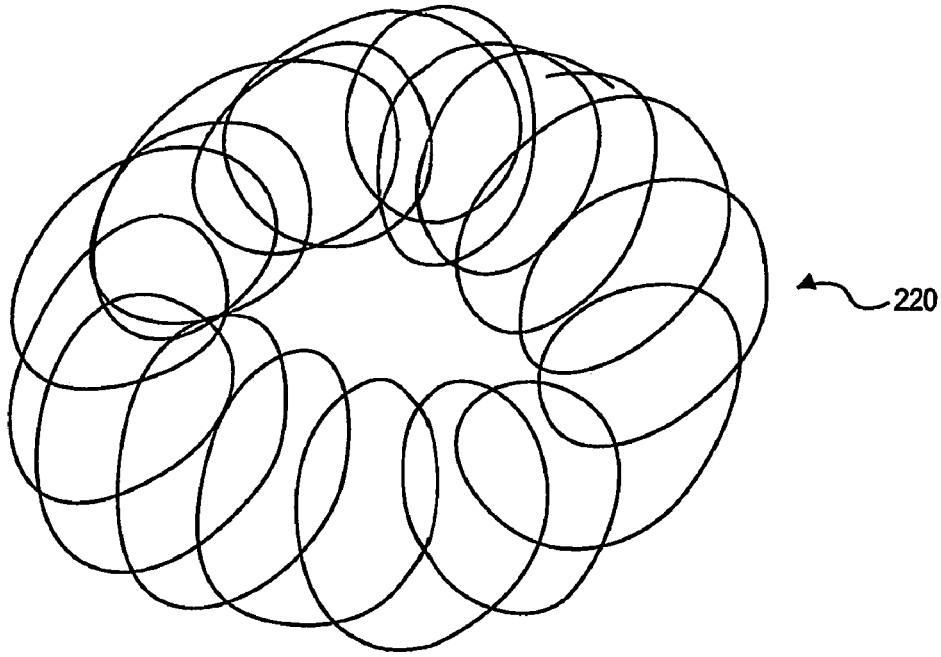
FIG. 7A is a diagrammatic view of a particular segment of product in its natural stretched out or deployed state.

Accordingly, FIG. 7A is a diagrammatic view of a segment of product 220 in its natural stretched out or deployed state. As shown, the natural deployed state of the product segment 220 is in the form of a donut. As may be appreciated, such a configuration may be provided by a pattern of attachment points that are placed on one side of the product coils.

Figure 7B:
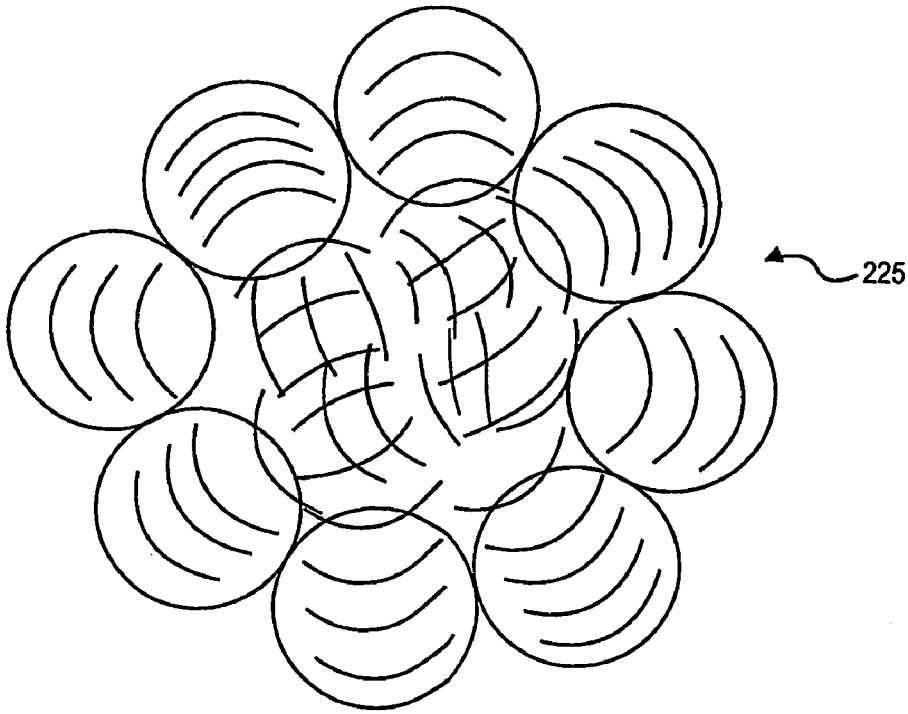
FIG. 7B is a diagrammatic view of a segment of concertina product configured to generally form a ball in a deployed state.

FIG. 7B is a diagrammatic view of a segment 225 of barbed tape product configured to generally form a ball in a deployed state. As may be appreciated, the attachment points required to form a ball may be placed to generally form hoops, but which cause the product to bend out of a plane of each hoop and into a subsequent hoop plane so that the result is the ball configuration shown in FIG. 7B, for example.

Figure 8A:
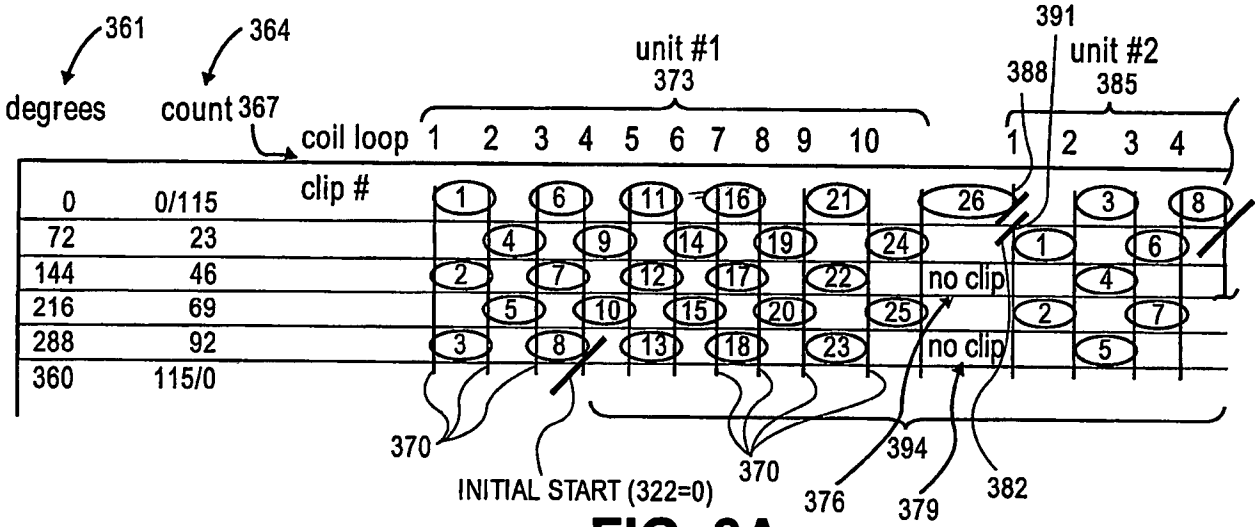
FIGS. 8A and 8B are tables of an exemplary attaching sequence in accordance with a predetermined pattern that may be programmed into an electronic controller in accordance with the present invention.
Figure 8B:
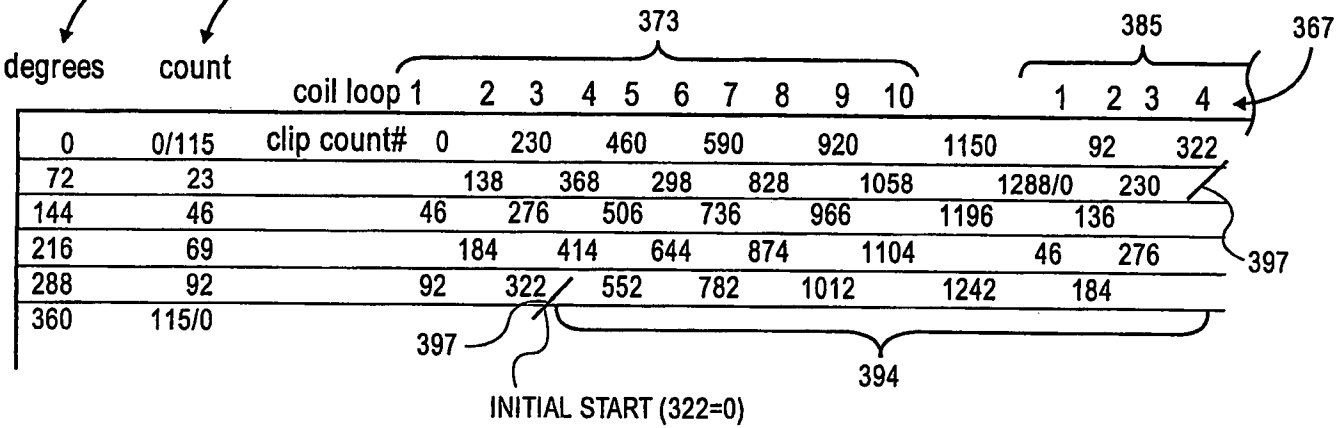

FIGS. 8A and 8B are tables showing an exemplary clipping sequence that may be programmed into the electronic controller in order to produce a barbed tape product of a particular configuration. The specific example shown in FIGS. 8A and 8B is for a ten loop coil with 5 clips per 720 degrees (pair of loops), and 26 clips total. The tables also include indications of steps for suspending clipping for a predetermined number of intervals or counts between coils, for example. An interval or "count" as used herein is defined as the distance between adjacent sets of barbs along the product strand 95. The motorized paddle 102 may register the number of intervals during which clipping is suspended as well as registering the number of intervals between clipping at the predetermined attachment points. Therefore, the motorized paddle may function as a counter and an index paddle to function as will be described below. Alternatively, a separate counter and/or index paddle may be provided.

In the table of FIG. 8A, a first column 361 indicates a position in degrees at which clips are to be attached. A second column 364 indicates a distance at which the clips are attached in terms of intervals or counts along the product strand in each coil. A first row 367 of the table indicates which loop is being clipped by sequential numbers of loops listed from left to right. The numbers in the body of the table of FIG. 8A represent clip numbers in the sequence in which they are attached. The vertical lines 370 represent the loops of a strand of product and the lines encircling each of the clip numbers and intersecting pairs of loops represent attachment of the clips to respective loops of the strand. Thus, as shown in FIG. 8A, clips 1 through 3 attach the first loop to the second loop. It is to be noted that the first clip is attached at a position designated at zero degrees and zero counts. In the particular sequence illustrated in FIGS. 8A and 8B, the sixth clip will also be located at zero degrees. However, when the sixth clip is attached, 115 intervals or counts of the strand will have passed through the clipping device subsequent to attachment of the first clip. As shown, the sequence of clipping proceeds in a helically progressive pattern as described above, with sequential clips being attached every 144 degrees until a coil or unit 373 has been completed.

At the end of the coil or unit 373, the system skips attaching two sequential clips as indicated at 376 and 379. Then the machine is stopped and the strand of product is cut off at a position corresponding to break lines 382. With the machine stopped, the coil or unit 373 is pushed off the take up reel, a counter is reset, and the machine is started again. The steps of cutting off, pushing off, and resetting the counter each require an additional time. Accordingly, a separate "delta t" is programmed or otherwise implemented in the electronic controller to provide time for each of these steps between coils. No stopping is required along the strand at the positions where clipping is skipped so a cumulative "delta t" need not be large. Furthermore, a segment of approximately 8 counts may be provided in which the strand is cut. The segment may be greater or less than 8 counts, but provides a length of product that enables separating of adjacent loops therefrom in order to insert a clipping tool. The segment may be 10 or more counts, or may be as few as 2 to 4 counts. The segment shown in FIG. 8A is 23 counts and aligns the attachment points of the first unit 373 with the attachment points of a second unit 385 for ease of illustration. The segment extends between clip number 26 (the last clip of the first unit 373) and clip number 1 of the second coil or unit 385. The cut will generally be made in a central portion of the segment leaving tails forming free ends 388 and 391 extending from respective clip numbers 26 and 1. Any number of clippings may be skipped and any length of segment for cutting the strand may be provided under electronic control. However, as shown, skipping attachment of at least two clips permits a clean break between the units 373 and 385 by a single cut.

Advantageously, the starting and ending point for a cycle 394, generally corresponding in length to a length of strand for a coil or unit 373, may be selected so as not to correspond to the cut off point. For example, a starting and ending point for the cycle 394 shown in FIGS. 8A and 8B is at clip number 9. In this way several loops of product strand are on the take up reel and threaded in the clipping device when the strand is cut between coils or units 373 and 385. At least a portion of these several loops remains threaded in the clipping device and fed onto the take up reel during and after cutting. Therefore, refeeding and rethreading the strand for each coil or unit is not required. Furthermore, an index of the strand is preserved since the counter or index paddle is continuously engaged. On the other hand, if the starting and ending point is made to correspond to the cut off point, then the strand would have to be rethreaded through the clipping device and refeed onto the take up reel and index paddle. Such rethreading and refeeding requires down time for the machine and reduces efficiency. Furthermore, continuous operation is difficult if not impossible. On the contrary, the clipping sequences of the present invention have the capability of preserving the index, permitting the steps of cut off, push off, and resetting the counter while remaining under the control of the electronic controller. It is contemplated that the cut off may be effectuated by the clipping machine. Alternatively, a separate machine could perform the cut off step. Further alternatively, a human operator could manually clip during a time interval provided by the electronic controller.

FIG. 8B is a table similar to the table of FIG. 8A. However, the table of FIG. 8B has the number of counts for a given coil at respective attachment points for units 373 and 385 indicated in the body of the table instead of the clip numbers. Thus, a running count for a coil or unit goes from zero up to 1,288, after which the counter is reset to zero again. On the other hand, the electronic controller is set to a starting point for the cycle 394 when the count reaches 322 as indicated by a slash 397. Thus, the cut off and associated steps may be advantageously implemented at an intermediate point in the cycle 394 as described above.

While the tables of FIGS. 8A and 8B show the clips sequentially attached at evenly spaced increments along the strand, it is to be understood that the attachment points can be varied to advantageously provide the offset of the clips from one pair of loops to another as has been described with respect to FIGS. 2A-7B above. This may be implemented with clipping and cut off sequences similar to those of FIGS. 8A and 8B. For example, instead of clipping after each subsequent 46 counts, the clipping sequence may implement clipping at alternating intervals of 45 and 47 counts to achieve the advantages of offsetting the clips along axial lines of a coil in addition to the advantages of the clipping and cut off sequences shown and described with regard to FIGS. 8A and 8B.

Figure 9A:
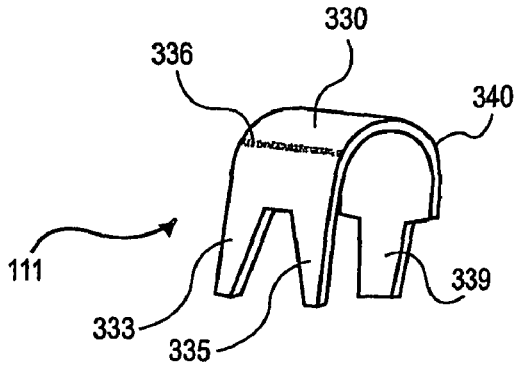
FIG. 9A is a perspective view of an attachment element.

FIG. 9A is a perspective view of the attachment element or clip 111. As shown, the clip 111 has a base 330 and a pair of arms 333, 335 extending from a first end 336 of the base and a single arm 339 extending from a second end 340 of the base 330. The clip 111 has a generally U-shaped configuration. This configuration is similar to a staple structure in which the arms 333, 335, and 339 extend transversely away from the base 330 to form the U-shaped configuration.

Figure 9B:
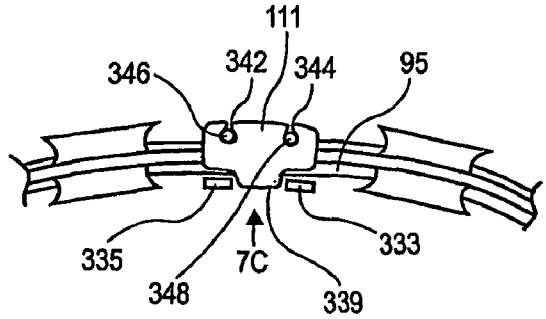
FIG. 9B is a side view of an attachment element clipped onto a pair of product strands.
Figure 9C:
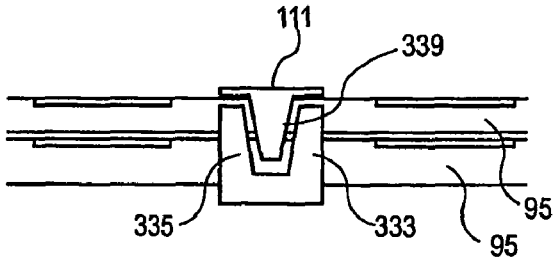
FIG. 9C is a bottom view taken in a direction of arrow 9C of FIG. 9B.

As shown in FIGS. 9B and 9C, the clip 111 may be placed in a generally embracing configuration around a pair of product strands 95. The clip 111 is then crimped onto the product strands 95 into an interleaved configuration as shown in FIG. 9C. That is, the pair of legs 333 and 335 receive the single leg 339 therebetween. Advantageously, the clip 111 may be provided with slits 342 and 344 that receive respective filaments 336 and 348 therein. Additional details with regard to the slits and filaments will be described below.

Figure 9D:
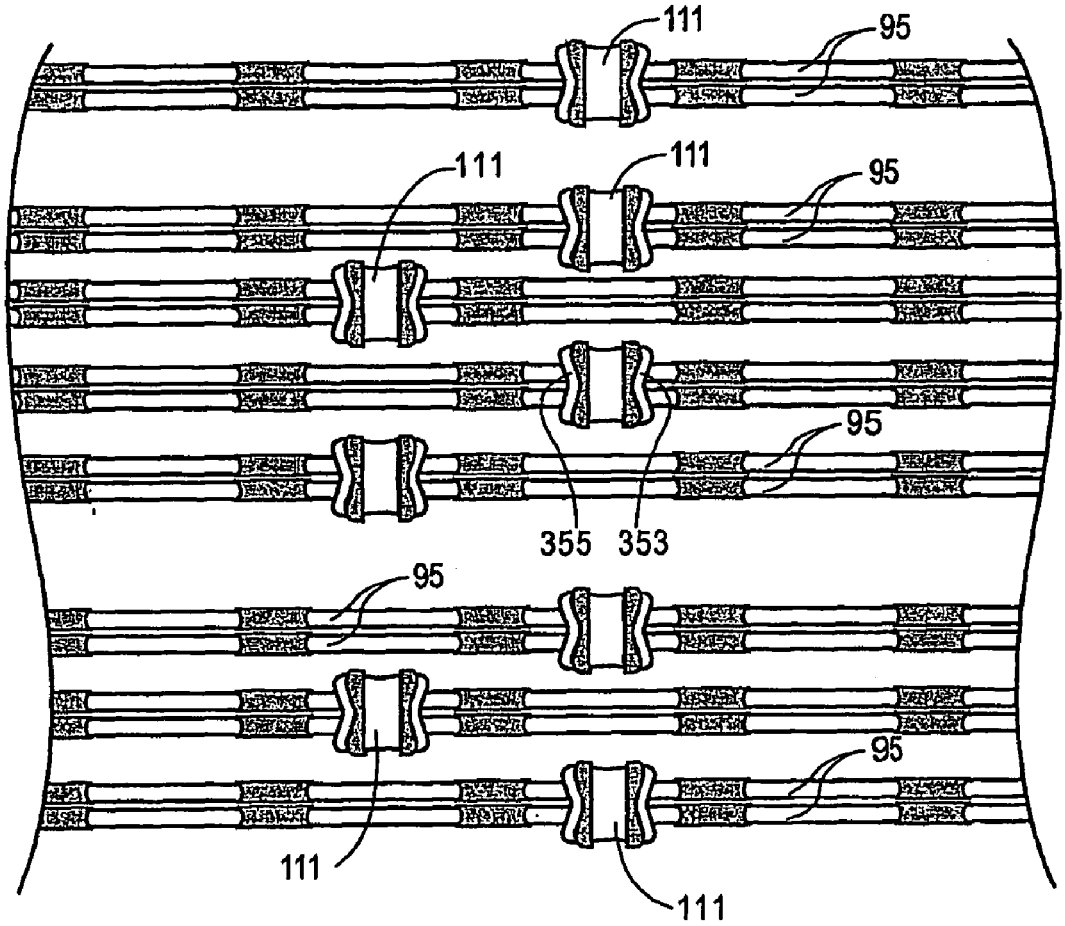
FIG. 9D is a top view of a plurality of attachment elements in a clipped configuration on a respective plurality of pairs of product loops.

FIG. 9D is a top plan view of a plurality of clips 111 attaching strands 95 of adjacent loops together. As may be appreciated, FIG. 9D is a cut away view showing only one region of attachment points of an overall coil of strand 95. As shown, an attachment point defined by an attachment element or clip 111 is offset relative to attachment points on adjacent pair of strands 95. The exception is in the exemplary view of FIG. 9D is the upper two adjacent pairs of strands 95 in which the attachment points are aligned. FIGS. 9B through 9D effectively show how the system of the present invention accurately places the attachment elements 111 and avoids misclipping including placement of the attachment element or clip 111 on a barb, for example. Furthermore, as shown in FIG. 9D, placement of an attachment element or clip 111 in surrounding relation to a pair of strands has the advantage of slightly separating the pair of strands from stands adjacent to the pair. Thus, the target for placement of a subsequently placed clip is enlarged and an open space is provided for arm(s) on one side of the clip 111.

Figure 10A:
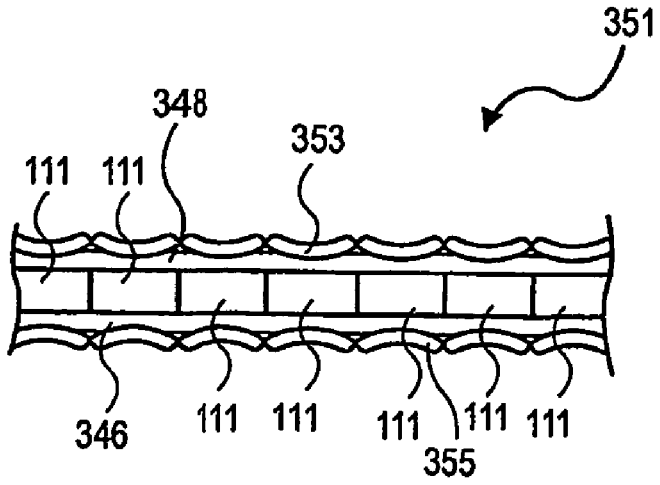
FIG. 10A is a top view of a string of attachment elements held together by common filaments.

FIG. 10A is a top plan view of multiple clips 111 in a string of clips 351. The string of clips 351 is held together by a pair of common filaments 346, 348. These filaments 346 and 348 are disposed in slits 342 and 344 respectively, and are common to all of the clips 111. The filaments 346 and 348 are held in the slits 342 and 344 by a compression fit. As shown in FIGS. 9D and 10A, this compression fit may be achieved by a crimping action that crimps outer side portions 353 and 355 inwardly to engage and compressively hold the filaments 346, 348 in the slits 342, 344. The filaments 346, 348 may be formed or comprised of a tough nylon material, for example. Thus, the clips 111 are held together by the filaments until they are separated during the manufacturing process.

It is to be noted that the inwardly crimping deformation of the outer sides 353 and 355 of the base 330 may provide a work hardening effect that strengthens these portions and the base 330 overall against subsequent bending. Furthermore, it is to be understood that a punching or stamping process for forming the slits 342 and 344 in the base 330 may also act to strengthen the material of the clips 111 surrounding the slits 342 and 344, by work hardening for example. Thus, the bases 330 of the clips 111 may be strengthened in longitudinally extending regions surrounding each of the slits 342 and 344. These strengthening effects were somewhat contraindicated since removal of material would typically be associated with a weakening of the region from which the material is removed.

Figure 10B:
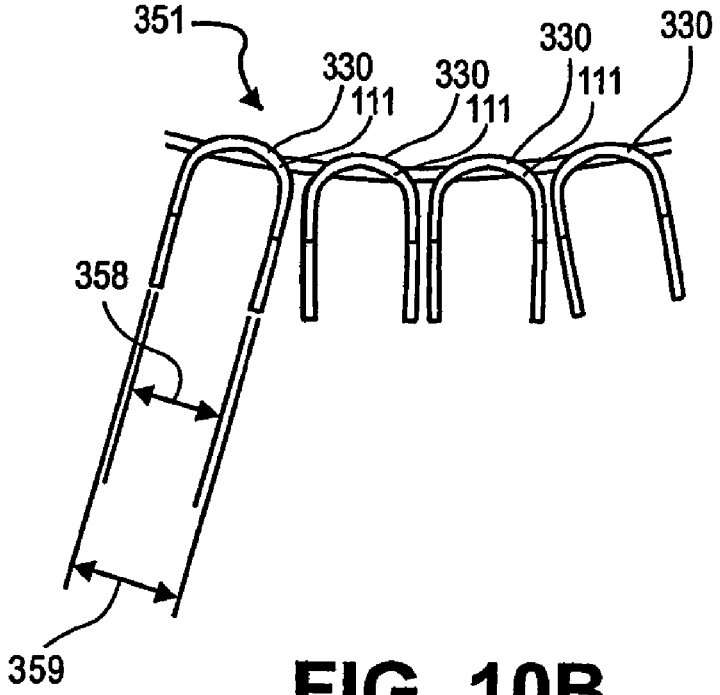
FIG. 10B is a side view of a string of attachment elements connected together by a pair of common filaments.

FIG. 10B is a side view of the string of clips 351. As shown in FIG. 10B, the arms on opposite ends of the base 330 extend generally parallel to each other away from the base 330. The length dimension of the base 330 thus corresponds to a maximum distance at which outer surfaces of the arms at opposite ends of the clips 111 are spaced. This dimension 359 may be 0.410+/−0.0325 inches, 0.410+/−0.010 inches, or 0.410+/−0.00 inches. A spacing dimension 358 corresponds to a[[n]] spacing between inner surfaces of the arms. This dimension 358 may be 0.290+/−0.0325 inches, 0.290+/−0.010 inches, or 0.290+/−0.00 inches. These dimensions are larger than those of clips available on the market at the time of this invention. In addition to the advantageous work hardening effect provided in the bases 330, it is to be understood that the bases have a generally rounded peak as opposed to a more flattened configuration in the clips of the past.

While the invention has been set forth above in terms of the exemplary embodiments shown in the Figures, it is to be understood that many variations are possible without departing from the spirit and scope of the present invention. For example, it is to be understood that the slits 342 and 344 could be placed in the bases 330 at an orientation rotated by 90 degrees. Thus, the lengths of the slits 342 and 344 would extend in side to side directions as opposed to length directions with respect to the bases 330. The materials utilized for the product and the attachment elements may be varied without departing from the spirit and scope of the invention. For example, the material for filaments 346 and 348 may be selectively varied. Configurations of the attachment elements may be changed without departing from the spirit and scope of the invention. It is to be understood that any attachment element could be used in place of clips 111 shown and described above. Furthermore, the concepts of the present invention could be applied in other applications. For example, a predetermined pattern of attachment points could be applied in making bed springs.

Thus, it can be seen that the present product could be provided in alternative forms. For example, a barbed tape product may be formed of a tape without the reinforcing wire shown and described with regard to FIG. 1. In such cases, providing attachment points in accordance with the details above can still be advantageously implemented.

Thus, it can be seen that the present system and method associated therewith provide advantages over past systems and methods. It is to be understood that the system may include additional machines or elements without departing from the spirit and scope of the present invention. Likewise, some of the devices of the system may be omitted without departing from the scope of the invention. For example, a barbed tape concertina or other barbed tape product may be formed of a tape without the reinforcing wire shown and described with regard to FIG. 1. In such cases, providing attachment points by an automatic clipping gun and operating the system under control of an electronic controller can still be advantageously implemented. The system and method of the present invention is not dependant on the materials used to form the product. Rather, forming the product of any materials is considered to be within the spirit and scope of the present invention. Furthermore, the order of the steps of the present method may be changed without departing from the spirit and scope of the invention. For example, clipping need not occur in a helically progressive order to provide a helically progressive pattern in a finished barbed tape concertina product. In this regard, it is possible that several adjacent loops could be clipped in a first attachment region before loops in a second attachment region circumferentially spaced from the first region without departing from the spirit and scope of the present invention. Furthermore, this non-helically progressive order may be applied to other barbed tape products that are not concertina products. Still further, it is to be understood that while the distances of the offsets described herein may have ideal magnitudes, the present invention is not intended to be limited to offsets of a particular distance. Rather, the present invention is considered to encompass any and all circumferential offsets, including offset distances that approach zero.

Figure 11A:
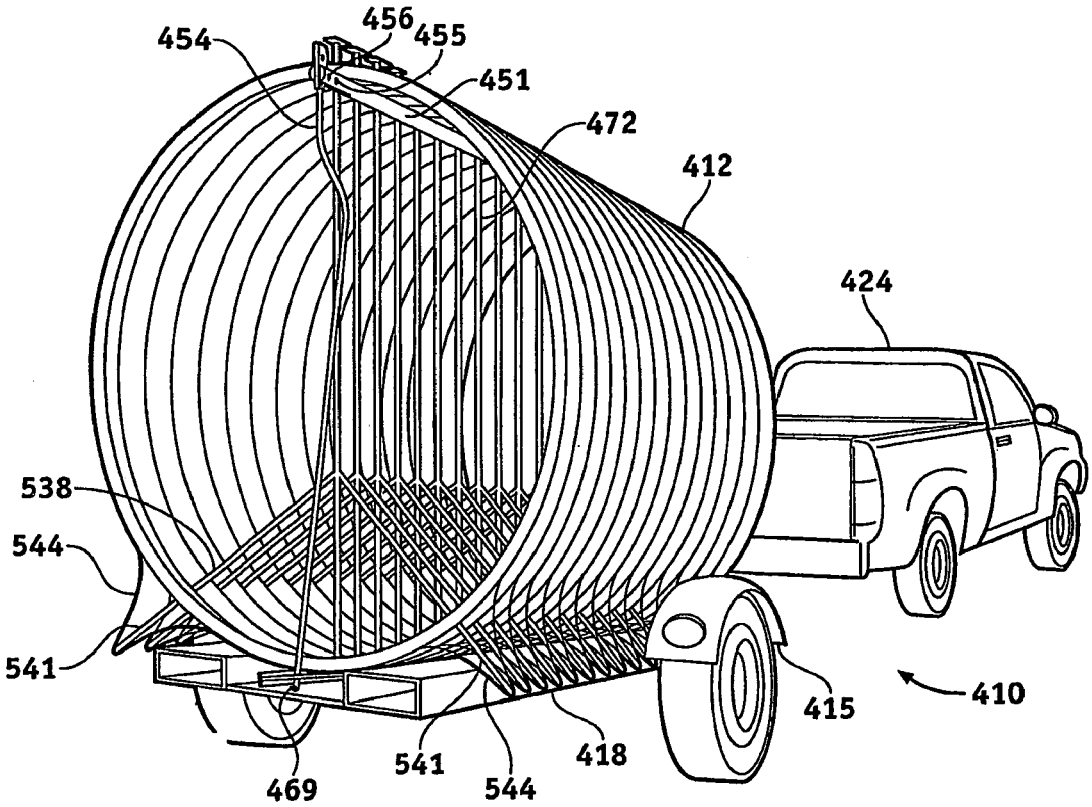
FIG. 11A is a perspective view of the product and magazine on the transport vehicle according to an embodiment of the present invention.
Figure 11B:
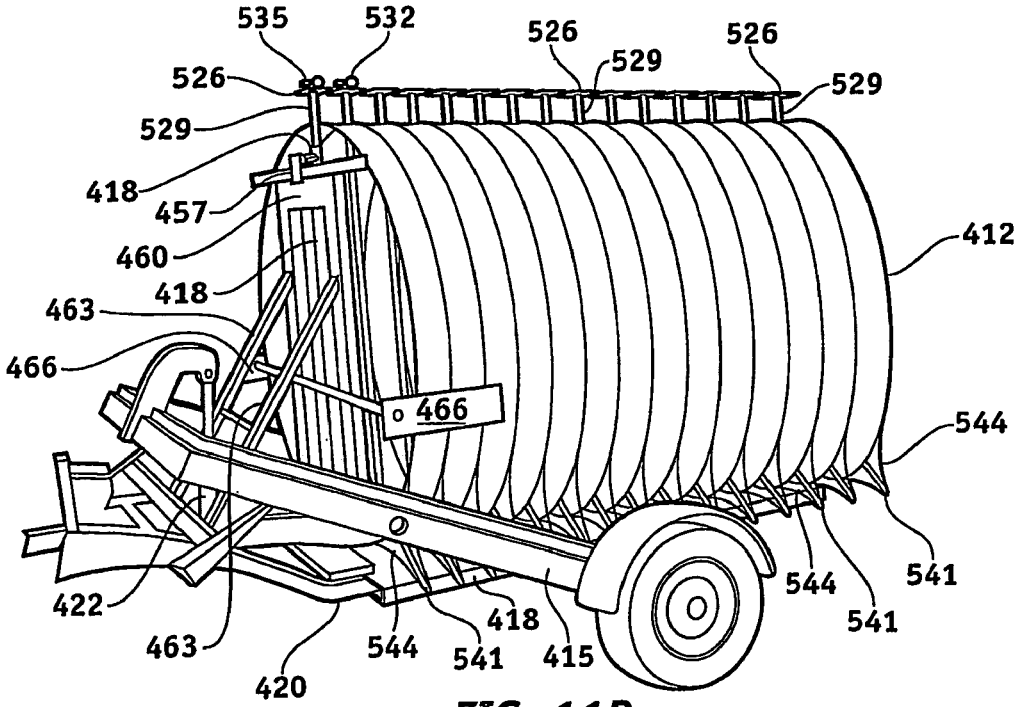
FIG. 11B is another perspective view of the product and magazine on the transport vehicle according to an embodiment of the present invention.

As discussed above, embodiments of the present invention relate to concertina tape products and systems for stable deployment and retrieval of the products. A deployment system 410 with a concertina tape product 412 is shown in FIG. 11A. As shown in FIGS. 11A and 11B, a trailer 415 may be a modified form of an Amaz-N-Tow™ trailer. A magazine 418 for holding the product may be supported on forks 420 of the trailer 415. Thus, the magazine 418 and the product may be raised and lowered as desired by a hydraulic ram before, during, and after deployment and/or retrieval of the product 412. As shown, the trailer 415 may be pulled by a tow vehicle such as pickup truck 424.

Figure 12A:
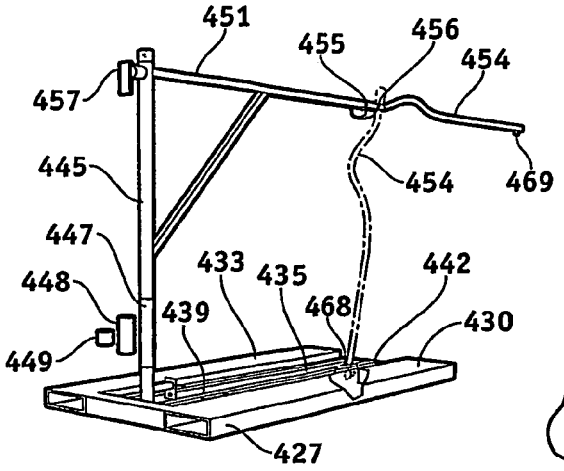
FIGS. 12A-12B are a perspective views of the magazine according to an embodiment of the present invention.

FIG. 12A show the magazine 418 in an unloaded state. The magazine may have a base 427 with two receivers 430, 433 for receiving the forks 420 of the trailer 415. The base 427 may also include a support channel 436 supported on cross bars 439, 442 that extend between the receivers 430, 433. An upright member 445 may be mounted at a first end of the base 427 and may be height adjustable by selectively inserting one of a variety of different height shims 447, 448, 449. A cantilever support member 451 may have a first end mounted on the upright member 445 and extend in overlying relation to the base toward a second end thereof. A gooseneck member 454 may be removeably mounted to the second end of the cantilever support member 451 by first and second pins 455, 456 for selective positioning in one of two configurations. The first configuration is shown in solid lines in FIG. 12A and is a configuration for deployment of the product. The second configuration is shown in dashed lines and is a securing configuration for holding the product on the magazine against inadvertent falling off. A third configuration with the gooseneck member 454 completely removed may be used for retrieving the product and placement thereof on the magazine 418.

Figure 12B:
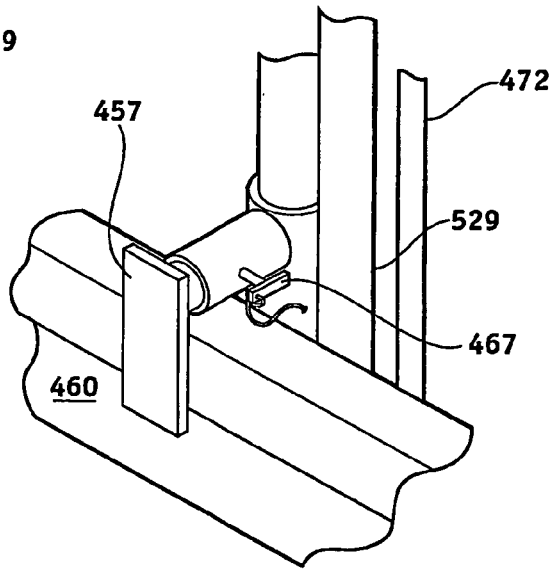

As shown in FIGS. 11B, 12A, and 12B, The magazine 418 may have a latch 457 that releaseably connects the magazine 418 to the trailer 415. In this regard, the modification of the Amaz-N-Tow trailer may include tow vehicle upright member 460, upright braces 463, and lateral supports 466, which may be adjustable in a width direction to accommodate coils or rolls of material of different widths. As shown in FIG. 11B, the trailer 415 has been modified to support the magazine 418 at a point near in height to an upper portion of the product 412. This advantageously adds great strength to the magazine and secures it and the product 412 against fore and aft movement as well as side to side movement. The latch 457 may also attach the magazine 418 to the tow vehicle upright 460 near a height of the cantilever support member 451. This configuration transfers loads from the product 412 and the magazine 418 to the tow vehicle upright member 460 and to the trailer 415 when the magazine is held on the trailer 415 by the latch 457 so that an extremely high moment will not be experienced at the connection point of the upright member 445 to the base 427. A pin 67 may be removed from a latch socket to release the latch 457 from a supported condition on the upright member 445 of the magazine 418. Thus, when the latch socket cannot be moved any higher on the upright member 445, such as with the eighty by 64 inch product, the latch may be removed and replaced once the magazine is in an abutting position against the tow vehicle upright member 460.

Additionally, the height of the cantilever support member 451 is approximately seventy-nine inches so that most of the weight of the product engages the channel member 436 via upright members and the product 412 itself. Thus, the force on the cantilever support and the upright member 445 is reduced.

As shown in FIG. 11A and the end view of FIG. 13, the gooseneck member 454 is in the securing configuration. The gooseneck member 454 in this configuration has been removed from the cantilever member 451. A second end of the gooseneck member 454 may be inserted in a keyed through opening 468 in the support channel 436, and rotated by 580 degrees. Then the first end of the gooseneck member 454 may be mounted by a second bolt 456 in the position shown in FIGS. 12A (dashed lines), 11A, and 13. This through opening 468 may be keyed to a protrusion 469 on the gooseneck member 454 that may be inserted through the opening 468 and rotated to inhibit inadvertent falling out of the second end of the gooseneck member 454 from the support channel 436.

As may be appreciated, the product 412 shown in FIGS. 11A, 11B, and 13 is a particular kind of product that includes upright trusses 472. While other products may be supported on the magazine 418, deployed therefrom, and retrieved thereon, the particulars of the product shown in FIGS. 11A, 11B, and 13 are also of importance because they may represent one of the largest diameter products that may be supported and transported on a particular military pallet that is in standard use today. The pallet is the L-463. Furthermore, the product shown may be provided in heights that are taller than the average man. For example, by starting with a coil diameter of approximately seventy-four inches, the vertical height may be extended to eighty inches by using an internal upright truss 472 of eighty-two inches that has a one inch deep notch in each end. A strand of the product may be disposed in each of the notches forcing the product into an oblong configuration that draws the sides inwardly to approximately sixty-four inches. This is advantageous because the product must also be kept within the width limits of the trailer 415. That is, the trailer has a sixty-six inch clearance between the wheel wells in which the product must fit. For the product shown in FIGS. 11A, 11B, and 13 at a height of eighty inches, the width will be sixty-four inches, which has only a small clearance relative to the wheel wells.

Other size requirements relate to fitting the product on the L-463 pallet and include length, height, and width requirements. The length must be no greater than one hundred and three inches, the height must not be greater than ninety-six inches, and the width must be no greater than eighty-eight inches. The product shown and described with regard to FIGS. 11A, 11B and 13 has been substantially maximized to provide a large product that will still meet these requirements. Products of greater or smaller sizes may be provided without departing from the spirit and scoop of the invention. However, within these maximum dimensions, the product and the magazine may be supported on the L-463 pallet, airlifted, and dropped to a position of deployment. The modified trailer 415 can also be palletized and dropped to the same position.

Figure 13A:
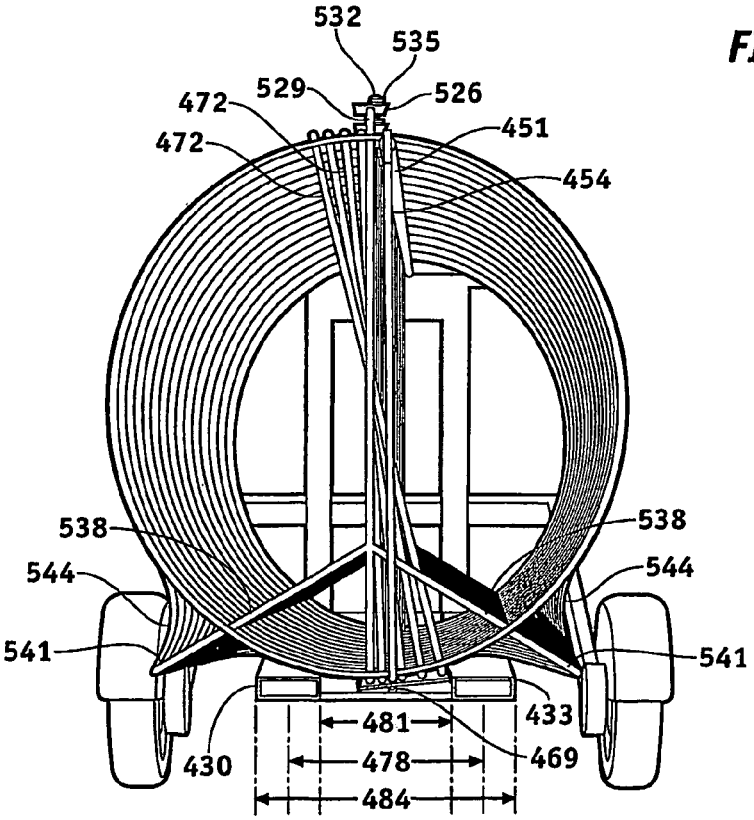
FIG. 13A is an end view of the product and magazine on the transport vehicle according to an embodiment of the present invention.
Figure 13C:
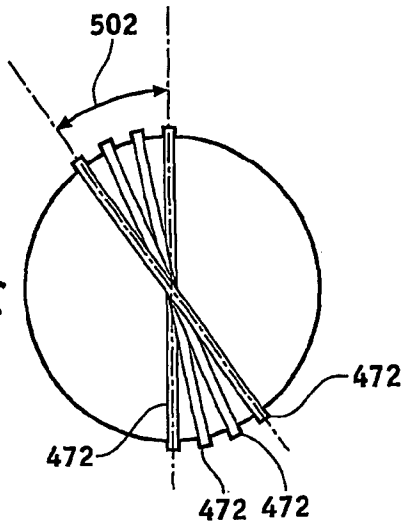
FIG. 13C is a diagrammatic view of uprights of the embodiment of FIG. 13A.

As shown in FIG. 13A, the receivers may be formed of four inch by ten inch rectangular tubing material. These receivers 430, 433 may be spaced from each other to have lateral centers as shown by a dimension 478 that are approximately twenty-six inches apart to mirror centers of the forks 420 on the Amaz-N-Tow. The forks on the Amaz-N-tow are six inches wide and two inches thick. Thus, the forks have a maximum spread of approximately thirty-two inches and a space therebetween of approximately twenty inches. With the receivers 430, 433 each centered twenty-six inches from each other, a tolerance of two inches on each side of each fork 420 and the receivers will be provided. A range of minimum to maximum spread for the openings of the receivers 430, 433 may thus be from approximately sixteen inches to approximately thirty-six inches. On the other hand, the magazine may be provided with receivers that are spaced in a range of approximately twelve to twenty inches apart at the narrowest part of the openings indicated by a dimension 481. Similarly, the widest part of the openings indicated by the dimension 484 may be in a range from approximately thirty-two inches to approximately forty inches, as shown in FIG. 13A. The openings could be made larger if so desired for even greater clearance.

Figure 13B:
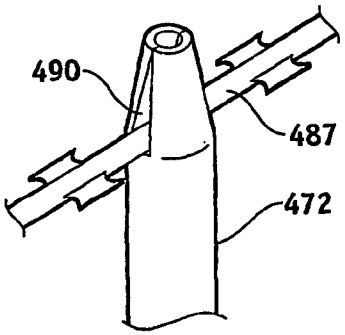
FIG. 13B is a perspective view of a connection of an upright to a strand of product.

The upright trusses 472 may be fixed to strands 487 of the product 412 at upper and lower portions of the coil by placement of the strands 487 in a notch 490 and crimping of the notch closed on the strands 487 as shown in FIG. 13B. This crimping has the advantages of keeping the strands from inadvertently coming out of the notch, and also prevents shifting of the upright trusses 472 along the strand. As shown in FIG. 13A and in the analogous diagrammatic view of FIG. 13C, the upright trusses are oriented in a range from approximately vertical to approximately thirty degrees to the left of vertical. This orientation of the upright trusses 472 is to accommodate precession that will occur during deployment.

Figure 13D:
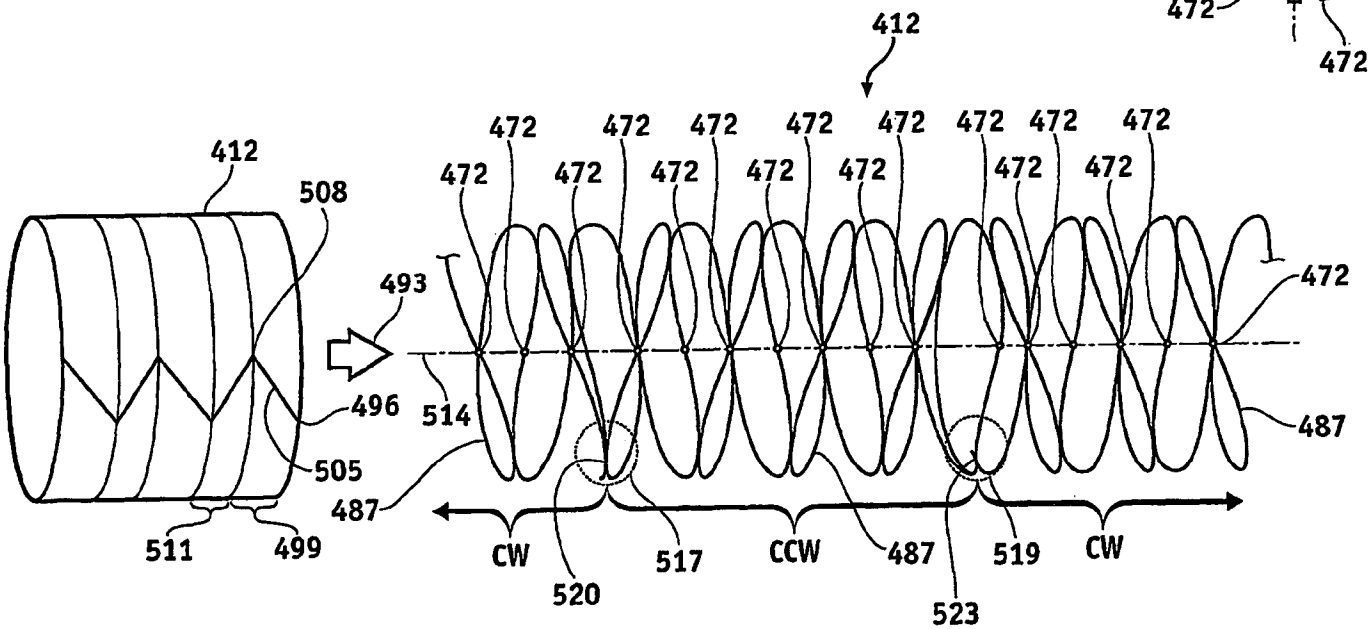
FIG. 13D is a diagrammatic view depicting the relation between counter-rotating and processing.

When deploying the product, the payout process is accompanied by rotation forces caused by the torsion that is caused as the product is expanded axially and the product moves radially from its largest diameter to a smaller diameter. These rotational forces if unresisted would cause precession of normally axially aligned clips. For example a 60 inch diameter unit with 9 clips would process one hour (30 degrees). Longer units will process further. For example, a five hundred foot unit would have a rotation of twelve hours (360 degrees) when deployed. In order for the upright trusses to be generally perpendicular to the ground and any external trusses to lie in a relaxed state when the product is deployed, the truss attachments need to be placed in a counter rotated configuration. This counter rotated form would cause the trusses 472 to extend radially outward from the coil along substantially the entire circumference of a coil and would cause the coil with its trusses to be non-compact. In order to keep any external truss portions in isolated regions of the coil, and in order to maintain the dimensions of the coil within those required as set forth above, the product can be manufactured with sequential segments of the coil having alternatingly clockwise and counter clockwise helically progressive configurations as shown in FIG. 13D.

Where the product 412 in its non-deployed state as shown to the left in FIG. 13D, as the product is drawn from a right end of the coil in the direction of arrow 493, a reference point 496 corresponding to the attachment of the upright truss 472 at an upper portion of the coil and represents the point of maximum rotation during deployment of a first segment 499. To compensate, the upright truss is attached at eleven o'clock and rotates clockwise through an angle of precession 502 shown in FIG. 13C to a twelve o'clock position during deployment. Subsequent upright trusses are counter-rotated less, generally along line 505 in the non-deployed configuration until the point 508 corresponding to the attachment of the last of the upright trusses of the first segment 499. A rightmost reference point of maximum rotation on the next segment 511 will rotate counterclockwise back to approximately eleven o'clock. With additional segments, the same alternating precession occurs for a net of zero precession as indicated by the line 514 having upright trusses disposed generally thereon as shown in the deployed section of product 412 to the right of arrow 493 in FIG. 13D. In this way, the compactness of the product in its non-deployed state may be maintained.

In order to form the coils in clockwise and counterclockwise directions, a table of the bender 90 may be shifted right or left in the bender portion of a system for forming the product 412. The segments are connected to each other in regions 517 and 519. In particular, ends of each segment may be attached to each other in a non-continuous configuration as shown at 520 and 523 in regions 517 and 519. In this way, the segments alternate between clockwise and counterclockwise progressions of the product strands 487.

Some of the trusses 472 may have platforms 526 on upper ends thereof as shown in FIGS. 11B and 13A. Alternatively, stronger uprights 529 may be substituted for some of the upright trusses for the purpose of better supporting the platforms 526 and any components that may be supported thereon, such as lights 532 and/or motion sensors 535 for example. Other components may be mounted thereon, including but not limited to, cameras, transmitters, receivers, and markers. These platforms may be approximately six inches by six inches square to provide a sufficient area to mount electronics or other devices.

FIGS. 11A, 11B, and 13A also show additional trusses. Some of the additional trusses are lateral trusses 538 that are mainly internal trusses that will experience mostly compression forces similar to the upright trusses 472 and 529. These lateral trusses 538 are connected at internal ends to the upright trusses 472 and 529, and may extend downwardly and outwardly to a position exterior of the product coil. External tips 541 may be bend downward to engage the ground in a cleat like manner. The lateral trusses 538 extend to both opposite lateral sides to a position that provides a relatively large base for the product 412. In this way, the product 412 will be stable in a deployed configuration, even when shaped to be tall and narrow. The lateral trusses 538 may be formed of a flat stock or any other suitable material that may be welded or otherwise fixed to the upright trusses 472 and 529.

Others of the additional trusses shown in FIGS. 11A, 11B, and 13A include spurs 544. The spurs 544 may be external trusses that are formed of portions of product that are connected at a first connection to a strand of the coil, doubled over the external tips 541 of the lateral trusses 538, and connected to the strand on an opposite side of the first connection. This arrangement advantageously strengthens and stabilizes the lateral trusses 538. Furthermore, when a barbed tape product is used, the spurs 544 act as a deterrent to those that may attempted to breach or disable the barrier by manipulation thereof via grasping or engaging the tips 541. These spurs form external trusses that may be in tension or compression depending upon the forces applied to them. Under normal circumstances at least a lower extent of a spur 544 will be in tension while the lateral truss 538 that engages the spur 544 will be in compression.

Figure 14:
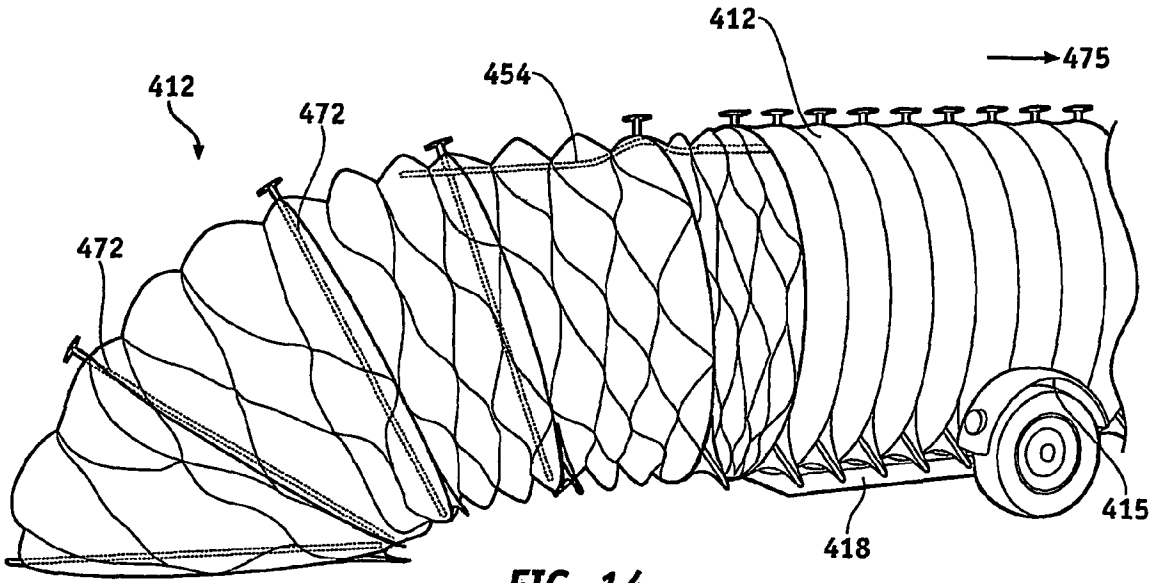
FIG. 14 is a side view of the product being deployed.
Figure 15A:
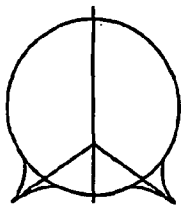
Figure 15B:
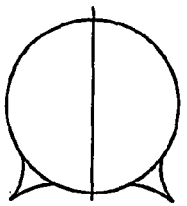
Figure 15C:
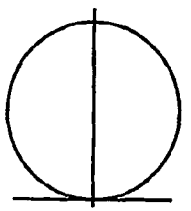
Figure 15D:
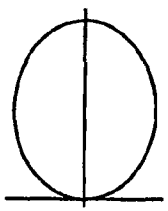
Figure 15E:
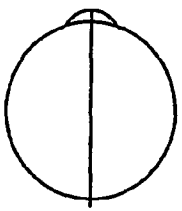
Figure 15F:
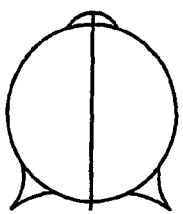
Figure 15G:
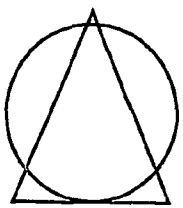
Figure 15H:
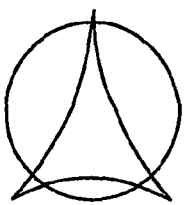

As shown in FIG. 14, the product 412 may be fixed to the ground and the trailer 415 may be pulled in a direction of arrow 475. The deployment capability of the present invention permits the erection of a barrier that can form the perimeter of a military compound, for example, in a very short period of time. A two hundred meter length of product 412 may be deployed from a single magazine 418 in approximately two minutes. This equates to the capability of deploying approximately one quarter mile of product in about four minutes. About one minute is needed to interconnect one coil of product 412 to another coil when one magazine has been emptied and another is to be connected for continued deployment of a barrier. Other products and other diameter coils may be used in conjunction with the deployment system of the present invention. As the height to width ratio of the product increases, the barrier becomes more like a wall than the traditional round barbed tape products of the past. Additionally, the width of the product may be varied over a length of the product to match a particular landscape or a particular urban environment, which may include wide or narrow streets lined by walls or other structures.

Once on site, the product may be deployed in a range from nine hundred to one to one thousand to one man hour ratio improvement for deployment of the eighty by sixty-four inch product. This is due to improved speed in deployment and the requirement of less men to accomplish the task. An improvement of three hundred to one may be achieved with the deployment system for thirty-eight inch and fifty-two inch diameter products as compared with the time and number of men required to deploy these products without the present system. This improvement is due to increased speed of deployment with the vehicle pulling approach, and to the reduced manpower requirement. The products of the present invention may be deployed by a single person. Two men may be used for a measure of improved security through redundancy. Retrieval may be accomplished by backing up the trailer 415. Normally the gooseneck member 454 will be removed during retrieval of the product, and manual placement of the product coil on the magazine may required so that retrieval of the product is more labor intensive than deployment. However, retrieval with the present system is still faster and easier that without. Automatic retrieval may be implemented by a device that has spring loaded fingers that move along a conveyor path, for example.

While the majority of this description has been directed to the eighty by sixty-four inch concertina product, it is to be understood that a large variety of other configurations of concertina product may be implemented with the present system. FIGS. 15A-15H have configurations including a variety of upright trusses, lateral trusses, spurs, and blisters. Some of the configurations do not have lateral trusses or provide them in an alternative form from what has been described with regard to FIGS. 11A, 11B, and 13A above. The variety of trusses shown in FIGS. 15A-15H may be in compression or tension, and may be provided by strands of product, tubular members, flat stock, or other structural members.

FIGS. 16A-16P also have a variety of additional configurations. Once again, these configurations implement a variety of trusses that may be in tension and/or compression. Most of the configurations of FIGS. 16A-16P include a round coiled material similar to those shown and described above. On the other hand, the rounded coils may be shaped by the placement and relative dimensions of the trusses and product coils. For example, FIG. 16G shows a product configuration in which a coil may have been urged into a generally triangular section. FIG. 16H shows a product that was not formed of a coil at all. FIG. 16I shows a configuration that may include one or more of a connected spacer cable, sensor cable, and communications cable, as indicated by the small circles along the periphery of the coil. It is to be understood that such cable may be secured on an interior or an exterior of the product coil. FIG. 16P is a diagrammatic view showing the same configuration as that implemented for the eighty by sixty-four inch product described above. It is to be understood that these configurations may be implemented with any size coils, trusses, and/or other products.

FIGS. 17A-17G include a variety of configurations having intersecting coils. As shown, the intersecting portions form what appear to be petals of flowers. These petal shaped regions advantageously form integral trusses by virtue of stiffening the respective configurations along the intersections. The configuration of FIG. 17B may include a lateral truss as indicated by the horizontal dashed line shown therein. The configuration of FIG. 17E is similar to that of FIG. 17B, but may have a larger upper coil to provide a taller product of more uniform thickness throughout its height. The configuration of FIG. 17F is an example of how the overlap may be extended to a multiple overlap configuration. This advantageous configuration may be extended to any number of overlapping or intersecting coils. FIG. 17G depicts a single coil configuration that may be implemented as a simple concertina product. In this regard, it is to be understood that any of the teachings of the present invention may be combined with an otherwise simple concertina product coil to provide the respective advantages. For example, counter rotating segments of a simple concertina to reduce precession could be implemented with any and all of the configurations shown and described herein. On the other hand, counter rotating may not be needed with plural overlapping product coils since the help to reduce or inhibit precession. It is to be understood that any of a variety of trusses and blisters may be attached to the product including blisters or spurs that are positioned within the roll of product until deployment, at which time they extend outside the envelope of the product. Such blisters or spurs may deploy in an umbrella like action. Further alternatively, a three dimensional blister of spur may be formed by intersecting two or more short strands of product and attaching them to one or more loops of the product.

One of the advantages of an upright truss is shown and described with regard to FIGS. 18A and 18B. In particular, FIG. 18A shows sectional views of deployed products with four respective widths as indicated at 547, even though the heights and the original widths were the same. The progressively reduced width of examples 1-4 is due to elongation of the product in a z-axis direction into the page. As stated above, with the height held constant, the width of the product will decrease with increased deployment length. Alternatively expressed, the harder the product is pulled during deployment, the narrower its deployed width will be. Table 550 shows corresponding widths to lengths of deployment. For example, a product like the eighty by sixty-four inch product described above may reach a length of six hundred and fifty feet when stretched until its original sixty-four inch width shrinks to sixty inches. Similarly, the product could be stretched to nine hundred feet, which would yield a twenty inch width. As a practical matter, the product could be stretched to its maximum physical capacities and reach it narrowest possible width and yield a thousand foot length. In this case the width would not actually be zero as indicated in the table 550. However, it would be the practical minimum. On the other hand, the theoretical maximum length would be approximately one thousand four hundred for a completely planar barrier with no width.

Figure 19:
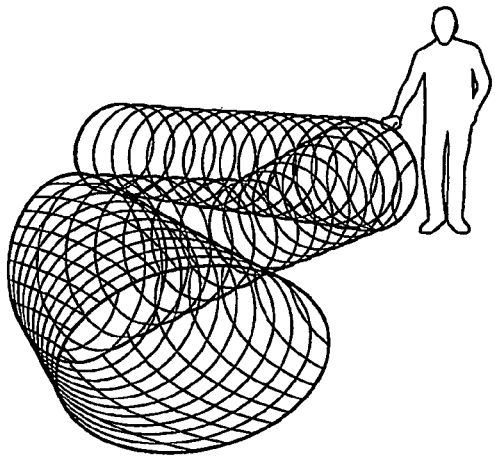
FIG. 19 is a perspective view of a deployed product.

With regard to narrowing a concertina product by stretching, it is to be understood that this and other methods of shaping the configurations of products of the present invention may be implemented. For example, the methods of shaping of copending U.S. patent application Ser. No. 10/959,944, entitled SYSTEM AND METHODS FOR FORMING BARBED TAPE CONCERTINA PRODUCT, by the same inventor, filed Oct. 5, 2004, incorporated by reference, including bending the product around turns, may be implemented with the present invention. In fact, it is to be understood that the product in accordance with the present invention could be deployed quickly with varying predetermined widths, heights, and bends to match a contour on which it is to rest in a deployed state, as depicted by the bending and curving product of FIG. 19. It is to be understood that the coil of material may be trussed for elongation in any direction. For example a wide flat coil may be achieved by a generally horizontal truss that is longer than the natural diameter of the coil. The configuration of the product may be changed along its length, and the shaping may be applied to different products of different sizes.

In some applications, the tow vehicle 424 and the trailer 415 may not fit between obstacles such as buildings, trees, rocks, or other objects. In such cases, an alternative magazine may be implemented. This magazine may be a hand cart 553 similar to that shown in FIG. 19. The hand cart may have a base 556, an upright member 559 that may be height adjustable by selective insertion of shims 562, 565, and 568. A first end of a cantilever support member 571 may be connected to an upper portion of the upright member 559. The cantilever support member 571 may extend in overlying relation towards a second end of the base 556. A gooseneck member 574 may be attached at its first end by a pair of pins 575 and 576 to a second end of the cantilever members, analogously to the gooseneck member 454 described above. However, the hand cart 553 may have a hand grip portion 578 mounted to the upright member as shown in FIG. 20.

Figure 20:
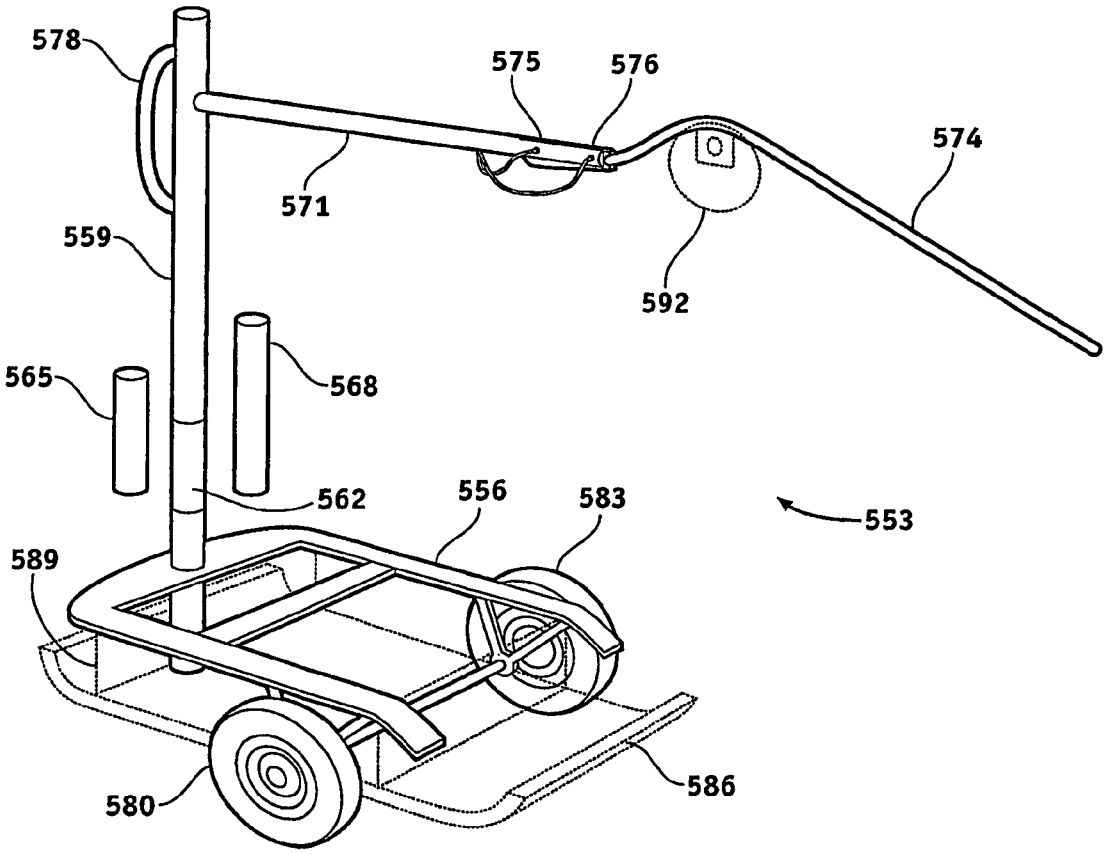
FIG. 20 is an a perspective view of an alternative magazine in accordance with the present invention.

FIG. 20 shows additional features that may or may not be implemented similarly on the magazine of FIGS. 11A-13A. For example, wheels 580, 583 may be provided to facilitate movement of the cart and a product to be carried thereon. The hand cart 553 may be configured for different sizes of product coils. In particular, the hand cart 553 may be capable of supporting thirty-eight inch and fifty-two inch diameter coils on the cantilever support 571 and the base 556. Additional features may further include a skid 586, which may be additionally or alternatively provided with or without the wheels 580, 583. This skid may be selectively deployable such as for environmental conditions that require it. For example, in deep loose sand, in snow, or mud, the skid 586 may prove beneficial. Another feature is a floatation mechanism 589, which may be permanently or selectively available. For example, the floatation mechanism 589 may simply be provided as a light weight buoyant material of relatively constant volume. Alternatively or additionally, the floatation mechanism may be provided as an inflatable enclosure. The floatation mechanism may thus advantageously provide buoyancy to the cart and any product supported thereon in swamps or when fording a stream, for example.

Another feature that may be applied to the hand cart 553 or the magazine 418, is an adjustable eccentric member 592 supported on the gooseneck. This eccentric member 592 may be rotated so that it provides a continuous guide of greater or lesser height for the loops of the concertina product being deployed. In this way, a greater or lesser restriction to passage of the loops off of the cantilevered supports 451, 571 and over the gooseneck members 454, 574 is provided. The result is that the spacing between adjacent loops of the product may be adjusted by raising or lowering the eccentric member 592. In a raised position, the resistance to passage of the product over the gooseneck 454, 574 will be increased. Therefore, the product will be stretched to a greater degree. For the products incorporating upright trusses, this results in narrower with barriers in the deployed state.

Thus, the product may be provided in any of a variety of shaped configurations within a roll or from roll to roll both by varying the clipping sequence as disclosed in the copending U.S. application Ser. No. 10/959,944, entitled SYSTEM AND METHODS FOR FORMING BARBED TAPE CONCERTINA PRODUCT, by the same inventor, filed Oct. 5, 2004, which is incorporated herein by reference. Additionally or alternatively, the product may be shaped by placement of the internal and external trusses described herein. Furthermore, the width of the product may be increased while a height is decreased by placement of a generally horizontal truss in the product. The resulting configuration that may be achieved by a predetermined pattern of trussing and/or clipping may be expressed a dynamic shaping action of the barrier during deployment along a Z-Axis that shapes the envelope in X-Y-directions.

The products herein described may be advantageously benefited by the particulars of the clips used in attaching the product to itself and to trusses. The particulars of copending U.S. patent application Ser. No. 10/959,531, entitled BARBED TAPE PRODUCT WITH A PREDETERMINED PATTERN OF ATTACHMENT POINTS AND ATTACHMENT ELEMENT, by the same inventor, filed Oct. 5, 2004, which is incorporated herein by reference, are pertinent. These clips have the advantage of a firm and more rigid attachment that is more stable and results in less misclipping, especially in an automatic clipping operation.

Figure 21A:
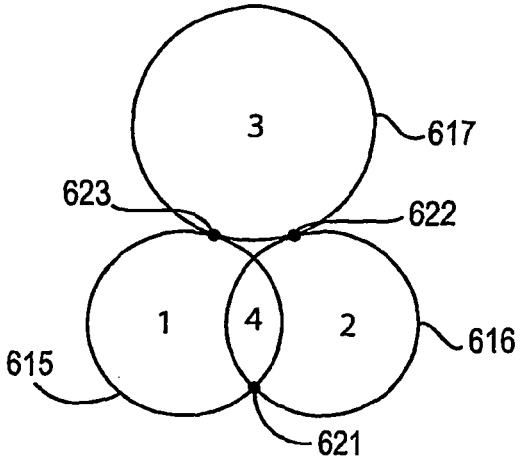
FIG. 21A is a diagrammatic view of a specific configuration of product similar FIGS. 17A-17G.
Figure 21D:
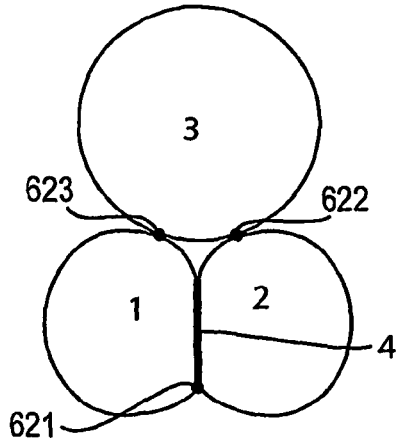
FIG. 21D is a diagrammatic end view of the product of FIG. 21A in the extended condition.

FIG. 21A is a diagrammatic end view of a specific configuration broadly encompassed in the embodiment of FIG. 17E shown and described herein. As shown in FIG. 21A, a product 612 may include three coils 615, 616, and 617 that are attached to each other in a manner that actually forms four barriers labeled 1, 2, 3, and 4. The fourth barrier may be formed by the intersection of the first and second coils 615 and 616, which may be attached in a manner to form an internal truss as has been discussed above. Also, it is to be understood that the attachment in this way also results in four patterns of attachment that may correspond to the four barriers. In this way it is to be understood that the material of the three coils is being utilized advantageously to form the four barriers 1, 2, 3, and 4 each having its own pattern of attachment although these barriers may share attachment elements. In particular, as shown in FIG. 21A, the coils 615, 616, and 617 may be attached to each other by attachment elements at 621, 622, and 623. In this case, there may be no attachment at the non-labeled intersection of coils 615 and 616.

Fewer attachment point and the associated fewer attachment elements advantageously enables a more compact product in the storage and shipping configuration. Thus, the configuration of FIG. 21A permits storage and shipment of a product having a compact length of approximately one hundred and three inches and that may be deployed along more than six hundred linear feet in a deployed condition. This may be achieved with approximately one thousand two hundred attachment element or clips in an axial row. Even though this configuration uses fewer attachment elements, it also provides an improved barrier against crawling through by a potential human intruder. The configuration of FIG. 21A also has fewer attachment elements than the embodiment of FIG. 17E because the additional ovals or ellipses between the third coil 617 and the first and second coils 615, 616 with their additional attachment elements have been eliminated.

Figure 21B:
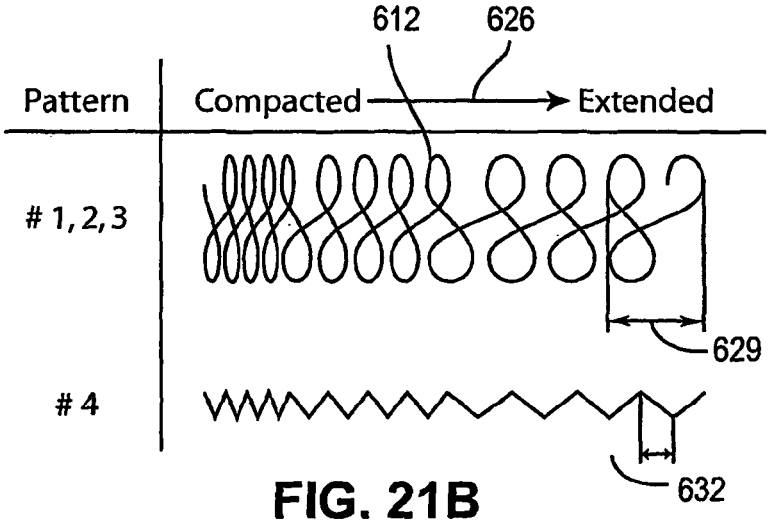
FIG. 21B is a diagrammatic top view of two profiles of respective patterns in the product of FIG. 21A as it is extended.

FIG. 21B is a table showing a diagrammatic depiction of the product 612 in accordance with the configuration of FIG. 21A with the product having a progressive extension toward a fully deployed state to the right as indicated by arrow 626. As shown, the product may have a predetermined maximum axial length 629 per loop of the first and second coils. The magnitude of this length is not to be limited, but may be approximately twenty-four inches, for example. The row labeled 4 in the table of FIG. 21B shows a physical pattern formed by the truss forming barrier 4 of FIG. 21A when viewed from above. As shown, this pattern is a zig zag pattern with each zig having a predetermined maximum axial length 632 of approximately one half the length 629 of the first, second, and/or third loops 615, 616, 617. As will be described in greater detail below, this limited length advantageously provides a spacer at the same time as the truss is formed.

Figure 21C:
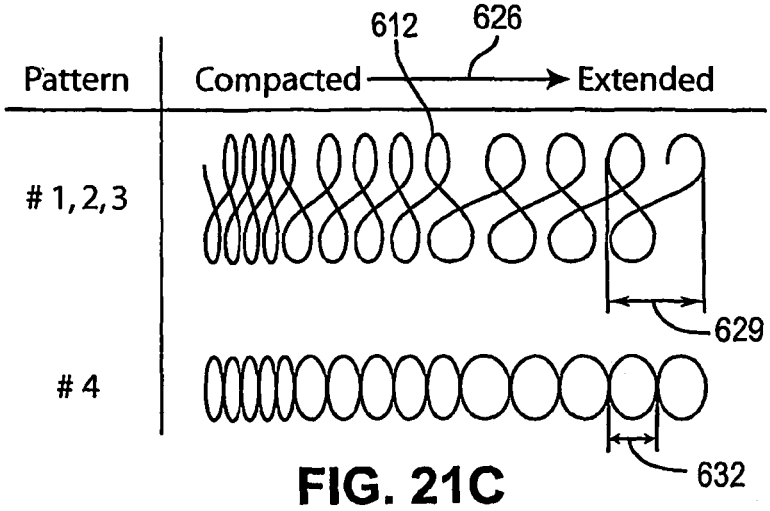
FIG. 21C is a diagrammatic side view of two profiles of respective patterns in the product of FIG. 21A as it is extended.

FIG. 21C is a table similar to the table of FIG. 21B except that FIG. 21C includes a diagram of the product 612 and the internal truss 4 as viewed from a side. As may be appreciated, the truss 4 in the compacted condition generally forms upright linear profiles. On the other hand, in an extended or deployed condition, the internal trusses form respective oval that become less oblong as the product is stretched to its maximum length when viewed from the side. By the same token, as the internal trusses 4 become less oblong in the side view, they form a progressively more linear or flat envelop when viewed from the end.

FIG. 21 D is a diagrammatic end view of the product of FIG. 21A. As shown, truss forming the fourth barrier 4 may form a generally upright linear structure as viewed from an axial end of the product in its fully deployed condition. In the fully deployed condition, the internal truss forming barrier 4 also forms a spacer. As viewed in FIG. 21A-21C, it may be appreciated that the barrier 4 may act to limit extension of the product 612 when stretched during deployment. That is, as the material of the coils in the regions forming the barrier 4 reaches its limits of flexibility, a maximum axial length is defined. Thus, the barrier 4 and associated internal trusses that form the barrier 4 provide multiple benefits including providing spacers.

As may be appreciated, the material of the coils of the products of the present invention contracts inward in response to stretching during deployment. For example, an eighty inch by sixty-four inch stowed product may contract to seventy-two inches by fifty-six inches when extended fully in the a deployed condition. The internal trusses formed by intersections between adjacent or overlapping product coils may be similarly effected as the product is stretched until the internal trusses reach a predetermined level of stiffness against bending or otherwise deforming.

Figure 22A:
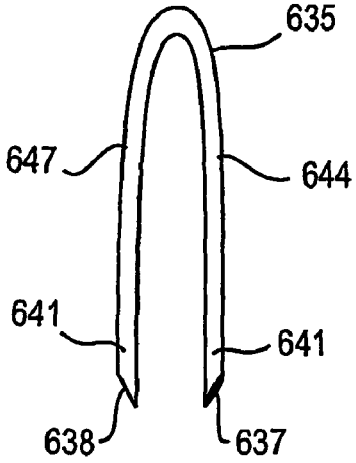
FIG. 22A is a diagrammatic view of an anchor that may be used to secure the products of the present invention to ground.
Figure 22B:
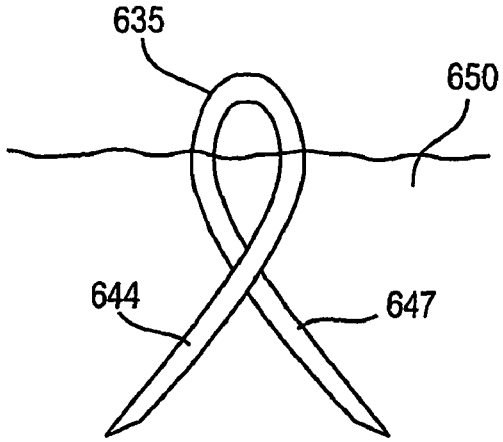
FIG. 22B is a diagrammatic view of the anchor in a driven condition.

FIG. 22A is a diagrammatic side view of an anchor 635 for securing product to the ground in accordance with the present invention. The anchor may have a U-shaped configuration and may have angled surfaces 637, 638 on tips 641 that will cause the legs 644, 647 of the anchor 635 to be directed in a crossing configuration as shown in FIG. 22B during anchoring. Although any material and any gauge of material may be used for the anchor, it has been found that six gauge wire may be used to achieve a sufficient sturdiness for most applications. As may be appreciated, one or more strand of product may be straddled by the legs 644, 647 and the anchor may be pounded into the ground 650. Thus, the anchor advantageously forms a branching anchor that is exceedingly secure against withdrawal in most soils.

Figure 23A:
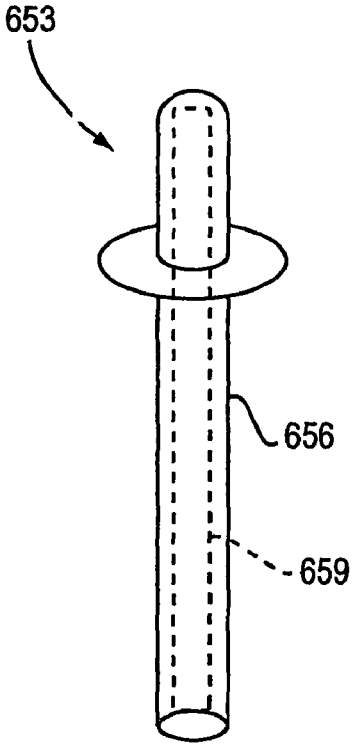
FIG. 23A is a perspective view of a driver hammer that may be used to drive anchors into the ground in accordance with the present invention.
Figure 23B:
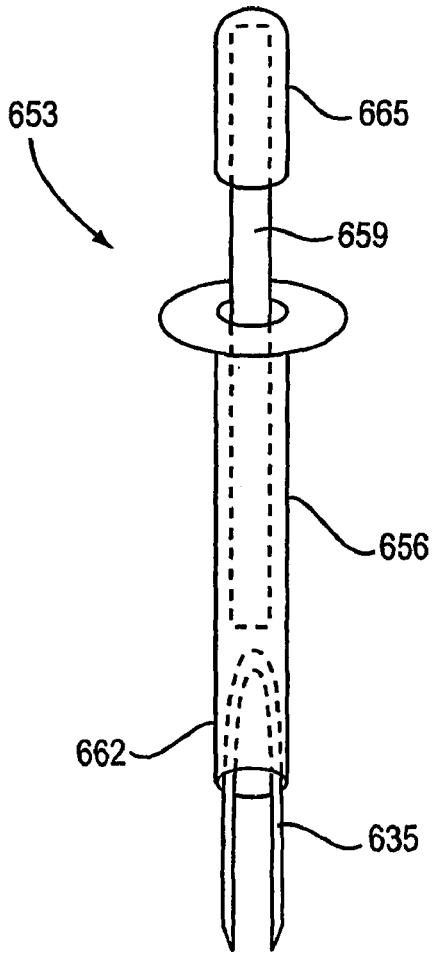
FIG. 23B is a perspective view of the driver hammer of FIG. 23A in use.

FIG. 23A is a perspective view of an anchor driver 653 for driving anchors 635 into the ground 650. The anchor driver is a hammer that may have an outer cylinder 656 and an inner plunger or rod 659. As shown in FIG. 23B, an anchor 635 may be inserted into the outer cylinder 656 and a lower end 662 of the outer cylinder and the anchor 635 may be positioned over one or more strand of product on the ground 650. Then a user may grasp a handle 665 of the plunger or rod 659 and repeatedly slide the rod 659 against an upper end of the anchor 635 in a hammering action to cause the anchor to penetrate into the ground 650. Thus, the anchor 635 and anchor driver 653 may advantageously be used to secure the products of the present invention in desired locations on the ground 650.

It is to be understood that the anchor driver 653 may be stowed on or within members of any of the magazines or stanchions that support the products of the present invention during storage and deployment. For example, the anchor driver may be conveniently disposed within the tubular member of the upright, cantilevered, or base portions of the magazines.

The magazines of the present invention may also be reconfigurable to form gates for the barriers that they support during storage, shipment and deployment. For example, the spacers 47, 48, 49 may be removed, a major portion of upright 45 may be moved down and rotated one hundred eighty degrees to form a gate for a secure area. Different combinations of gates may be formed, such as by inverting one or two cantilevered portions of stanchions of respective magazines for a lower gate barrier. Two magazines may be used to form posts of a two part gate that has respective swinging portions that meet in the middle. Thus any of a variety of desired access ports to a secured area may be formed with the aid of the magazines that also function to support and deploy the products of the present invention.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Many modifications and variations are possible in light of the teachings above without departing from the spirit and scope of the forthcoming claims. For example, clips may be provided as a bunch of loose individual clips. Such individual clips may be acquired in barrels and dispensed into a special bowl in the system. The bowl, in turn, delivers the clips into a clip gun for automatic clipping in accordance with the present invention.

The invention claimed is:

1. A plural coil tape product comprises:

a first coil extending from a first end to a second end along a first coil axis;

at least a second coil extending generally from a first end to a second end along a second coil axis generally parallel to the first coil axis; and the second coil intersecting the first coil in at least partially overlapping side by side relation, forming a plurality of intersections along the first and second coil axes; wherein:

at each intersection, the first and second coils are attached to each other and form an internal truss defined by the overlapping portions of the first and second coils wherein the internal truss forms a generally upright linear configuration as viewed from an axial end in a fully deployed state; and a respective plurality of the internal trusses generally form a repeating pattern of upright ovals along the first and second coil axes when viewed from a side.

2. The plural coil tape product of claim 1, wherein:

the respective plurality of the internal trusses generally form a zig zag pattern along the first and second coil axes when viewed from above when not in the fully deployed state.

3. The plural coil tape product of claim 2, further comprising a third coil intersecting the first and second coils in at least one circumferential position of each of the first and second coils.

4. The plural coil tape product of claim 2, wherein the zig has a maximum axial length of about one half the length of the first, second and/or third coils.

5. The plural coil tape product of claim 1, wherein the product may be deployed along about 600 linear feet from an initial length of about 103 inches.

* * * * *

UNITED STATES PATENT AND TRADEMARK OFFICE

CERTIFICATE OF CORRECTION

PATENT NO. : 7,883,074 B2
APPLICATION NO. : 10/585166
DATED : February 8, 2011
INVENTOR(S) : Michael V. Pavlov It is certified that error appears in the above-identified patent and that said Letters Patent is hereby corrected as shown below:

ON THE TITLE PAGE:
The last line of the Title should read as follows: --...deployment and retrieval...--

The last line of the Abstract should read as follows: --...external trusses for...--

IN THE SPECIFICATIONS:
Column 1, Line 7, the Title should read as follows:

Deployment and Retrieval

Signed and Sealed this
Twenty-second Day of March, 2011

David J. Kappos

David J. Kappos
*Director of the United States Patent and Trademark Office*